US007814978B2

(12) United States Patent
Steele et al.

(10) Patent No.: US 7,814,978 B2
(45) Date of Patent: Oct. 19, 2010

(54) CASING EXPANSION AND FORMATION COMPRESSION FOR PERMEABILITY PLANE ORIENTATION

(75) Inventors: David J. Steele, Arlington, TX (US); Travis W. Cavender, Angleton, TX (US); Roger L. Schultz, Ninnekah, OK (US); John C. Gano, Carrollton, TX (US); Grant Hocking, London (GB)

(73) Assignee: Halliburton Energy Services, Inc., Houston, TX (US)

( * ) Notice: Subject to any disclaimer, the term of this patent is extended or adjusted under 35 U.S.C. 154(b) by 235 days.

(21) Appl. No.: 11/610,819

(22) Filed: Dec. 14, 2006

(65) Prior Publication Data

US 2008/0142219 A1 Jun. 19, 2008

(51) Int. Cl.
*E21B 43/112* (2006.01)
*E21B 43/26* (2006.01)
*E21B 29/00* (2006.01)

(52) U.S. Cl. ..... 166/297; 166/308.1; 166/242.1; 166/212

(58) Field of Classification Search ..... 166/250.1, 166/308.1, 305.1, 177.5, 242.1, 206, 207, 166/212

See application file for complete search history.

(56) References Cited

U.S. PATENT DOCUMENTS 2,642,142 A 4/1949 Clark
2,687,179 A 8/1954 Dismukes
2,862,564 A 12/1958 Bostock
2,870,843 A 1/1959 Rodgers, Jr.
3,058,730 A 10/1962 Bays
3,062,286 A 11/1962 Wyllie
3,071,481 A 1/1963 Beach et al.
3,270,816 A 9/1966 Staadt (Continued)

FOREIGN PATENT DOCUMENTS

CA 2543886 4/2006

(Continued)

OTHER PUBLICATIONS

Halliburton Retrievable Service Tools, Cobra Frac® RR4-EV Packer, (2 pgs.) undated.

(Continued)

*Primary Examiner*—Kenneth Thompson
(74) *Attorney, Agent, or Firm*—Marlin R. Smith

(57) ABSTRACT

Casing expansion and formation compression for permeability plane orientation. A method of forming at least one increased permeability plane in a subterranean formation includes the steps of: installing a casing section in a wellbore intersecting the formation; expanding the casing section in the wellbore; and then injecting a fluid into the formation, the injecting step being performed after the expanding step is completed. Another method includes the steps of: applying an increased compressive stress to the formation, the compressive stress being radially directed relative to a wellbore intersecting the formation; and then piercing the formation radially outward from the wellbore, thereby initiating the increased permeability plane. Yet another method includes the steps of: applying a reduced stress to the formation, the reduced stress being directed orthogonal to a wellbore intersecting the formation; and then piercing the formation with at least one penetration extending radially outward from the wellbore, thereby relieving the reduced stress at the penetration.

33 Claims, 34 Drawing Sheets

U.S. PATENT DOCUMENTS 3,280,913 A 10/1966 Smith
3,338,317 A 8/1967 Shore
3,353,599 A 11/1967 Swift
3,690,380 A * 9/1972 Grable et al. ..... 166/298
3,727,688 A 4/1973 Clampitt
3,779,915 A 12/1973 Kucera
3,884,303 A 5/1975 Closmann
3,948,325 A 4/1976 Winston et al.
4,005,750 A 2/1977 Shuck
4,018,293 A 4/1977 Keller
4,311,194 A 1/1982 White
4,834,181 A 5/1989 Uhri et al.
4,977,961 A 12/1990 Avasthi
5,010,964 A 4/1991 Cornette
5,036,918 A 8/1991 Jennings, Jr. et al.
5,103,911 A 4/1992 Heijnen
5,105,886 A 4/1992 Strubhar et al.
5,111,881 A 5/1992 Soliman et al.
5,211,714 A 5/1993 Jordan et al.
5,318,123 A 6/1994 Venditto et al.
5,325,923 A 7/1994 Surjaatmadja
5,335,724 A 8/1994 Venditto et al.
5,372,195 A 12/1994 Swanson et al.
5,386,875 A 2/1995 Venditto et al.
5,394,941 A 3/1995 Venditto et al.
5,396,957 A 3/1995 Surjaatmadja
5,431,225 A 7/1995 Abass et al.
5,472,049 A 12/1995 Chaffee et al.
5,494,103 A 2/1996 Surjaatmadja et al.
5,547,023 A 8/1996 McDaniel et al.
5,564,499 A 10/1996 Willis et al.
5,667,011 A 9/1997 Gill et al.
5,765,642 A 6/1998 Surjaatmadja
5,829,520 A 11/1998 Johnson
5,944,446 A 8/1999 Hocking
5,981,447 A 11/1999 Chang et al.
6,003,599 A 12/1999 Huber et al.
6,116,343 A 9/2000 Van Petegem et al.
6,142,229 A 11/2000 Branson, Jr. et al.
6,176,313 B1 1/2001 Coenen et al.
6,216,783 B1 4/2001 Hocking et al.
6,283,216 B1 9/2001 Ohmer
6,330,914 B1 12/2001 Hocking et al.
6,443,227 B1 9/2002 Hocking et al.
6,446,727 B1 9/2002 Zemlak et al.
6,508,307 B1 1/2003 Almaguer
6,543,538 B2 4/2003 Tolman et al.
6,662,874 B2 12/2003 Surjaatmadja
6,719,054 B2 4/2004 Cheng et al.
6,722,437 B2 4/2004 Vercaemer et al.
6,725,933 B2 4/2004 Middaugh et al.
6,732,800 B2 5/2004 Acock et al.
6,779,607 B2 8/2004 Middaugh et al.
6,782,953 B2 8/2004 Maguire et al.
6,792,720 B2 9/2004 Hocking
6,991,037 B2 1/2006 Hocking
7,055,598 B2 6/2006 Ross et al.
7,066,284 B2 6/2006 Wylie et al.
7,069,989 B2 7/2006 Marmorshteyn
7,228,908 B2 6/2007 East, Jr. et al.
7,240,728 B2 7/2007 Cook et al.
7,278,484 B2 10/2007 Vella et al.
7,412,331 B2 8/2008 Calhoun et al.
7,647,966 B2 1/2010 Cavender et al.
2002/0189818 A1 12/2002 Metcalfe
2003/0230408 A1 12/2003 Acock et al.
2004/0118574 A1 6/2004 Cook et al.
2005/0145387 A1 7/2005 Hocking
2005/0194143 A1 9/2005 Xu et al.
2005/0263284 A1 12/2005 Justus
2006/0131074 A1 6/2006 Calhoun et al.
2006/0144593 A1 7/2006 Reddy
2006/0162923 A1 7/2006 Ware
2007/0199695 A1 8/2007 Hocking
2007/0199697 A1 8/2007 Hocking
2007/0199698 A1 8/2007 Hocking
2007/0199699 A1 8/2007 Hocking
2007/0199700 A1 8/2007 Hocking
2007/0199701 A1 8/2007 Hocking
2007/0199702 A1 8/2007 Hocking
2007/0199704 A1 8/2007 Hocking
2007/0199705 A1 8/2007 Hocking
2007/0199706 A1 8/2007 Hocking
2007/0199707 A1 8/2007 Hocking
2007/0199708 A1 8/2007 Hocking
2007/0199710 A1 8/2007 Hocking
2007/0199711 A1 8/2007 Hocking
2007/0199712 A1 8/2007 Hocking
2007/0199713 A1 8/2007 Hocking
2009/0032267 A1 2/2009 Cavender et al.

FOREIGN PATENT DOCUMENTS

EP 1131534 9/2003
WO 8100016 A1 1/1981
WO 0001926 1/2000
WO 0029716 5/2000
WO 2004092530 A2 10/2004
WO 2005065334 7/2005
WO 2007000956 9/2007
WO 2007012175 10/2007
WO 2007012199 10/2007
WO 2007017787 10/2007
WO 2007017810 10/2007
WO 2007017865 10/2007

OTHER PUBLICATIONS

U.S. Appl. No. 11/832,615, filed Aug. 1, 2007.
Halliburton Production Optimization, Cobra Frac® Service, (2 pgs.), dated Aug. 2005.
Halliburton Drawing No. D00004932, (2 pgs), dated Sep. 10, 1999.
Serata Geomechanics Corporation, "Stress/Property Measurements for Geomechanics," www.serata.com, dated 2005-2007.
ISTT, "Trenchless Pipe Replacement," (1 pg), dated Dec. 11, 2006.
ISTT, "Rerounding" (2 pgs), dated Dec. 11, 2006.
STAR Frac Completion System brochure, (4 pgs.), dated Winter/Spring 2006.
Wenlu Zhu, et al., "Shear-enhanced Compaction and Permeability Reduction: Triaxial Extension Tests on Porous Sandstone," Mechanics of Materials, (16 pgs.) dated 1997.
S.L. Karner, "What Can Granular Media Teach Us About Deformation in Geothermal Systems?" ARMA, dated 2005.
M.R. Coop, "The Mechanics of Uncemented Carbonate Sands," Geotechnique vol. 40, No. 4, (pp. 607-626), dated 1990.
M.R. Coop and J.H. Atkinson, "The Mechanics of Cemented Carbonate Sands," Geotechnique vol. 43, No. 1, (pp. 53-67), dated 1993.
T. Cuccovillo and M.R. Coop, "Yielding and Pre-failure Deformation of Structured Sands," Geotechnique vol. 47, No. 3, (pp. 491-508), dated 1997.
Lockner and Stanchits, "Undrained Pore-elastic Response of Sandstones to Deviatoric Stress Change," Porelastic Response of Sandstones, (30 pgs.) dated 2002.
Axel Kaselow and Serge Shapiro, "Stress Sensitivity of Elastic Moduli and Electrical Resistivity in Porous Rocks," Journal of Geophysics and Engineering, dated Feb. 11, 2004.
Lockner and Beeler, "Stress-Induced Anisotropic Porelasticity Response in Sandstone," dated Jul. 2003.
G.V. Rotta, et al., "Isotropic Yielding in an Artificially Cemented Soil Cured Under Stress," Geotechnique, vol. 53, No. 53, (pp. 493-501), dated 2003.
T.F. Wong and P. Baud, "Mechanical Compaction of Porous Sandstone," Oil and Gas Science and Technology, (pp. 715-727), dated 1999.
U.S. Appl. No. 11/832,602, filed Aug. 1, 2007.

U.S. Appl. No. 11/966,212, filed Dec. 28, 2007.
U.S. Appl. No. 11/832,620 filed Aug. 1, 2007.
U.S. Appl. No. 11/545,749, filed Oct. 10, 2006.
U.S. Appl. No. 11/753,314, filed May 24, 2007.
U.S. Appl. No. 11/977,772, filed Oct. 26, 2007.
Office Action issued Jan. 26, 2009, for U.S. Appl. No. 11/832,615, 23 pages.
Office Action issued Feb. 2, 2009, for Canadian Patent Application Serial No. 2,596,201, 3 pages.
International Search Report and Written Opinion issued Oct. 8, 2008, for International Patent Application No. PCT/ US081070780, 8 pages.
International Search Report and Written Opinion issued Sep. 25, 2008, for International Patent Application No. PCT/US07/87291, 11 pages.
Office Action Issued Jun. 16, 2009, for U.S. Appl. No. 11/832,602, 37 pages.
Office Action issued Jun. 17, 2009, for U.S. Appl. No. 11/832,620, 37 pages.
Office Action issued Sep. 24, 2009, for U.S. Appl. No. 11/966,212, 37 pages.
International Preliminary Report on Patentability issued Feb. 11, 2010, for International Patent Application Serial No.PCT/US08/070756, 10 pages.
International Preliminary Report on Patentability issued Feb. 11, 2010, for International Patent Application Serial No. PCT/US08/070776, 8 pages.
International Preliminary Report on Patentability issued Feb. 11, 2010, for International Patent Application Serial No. PCT/US08/070780, 7 pages.
International Search Report and Written Opinion issued Jul. 2, 2010, for International Patent Application Serial No. PCT/US09/63588, 15 pages.
Office Action issued Jul. 21, 2010, for U.S. Appl. No. 12/625,302, 32 pages.

* cited by examiner

FIG.25
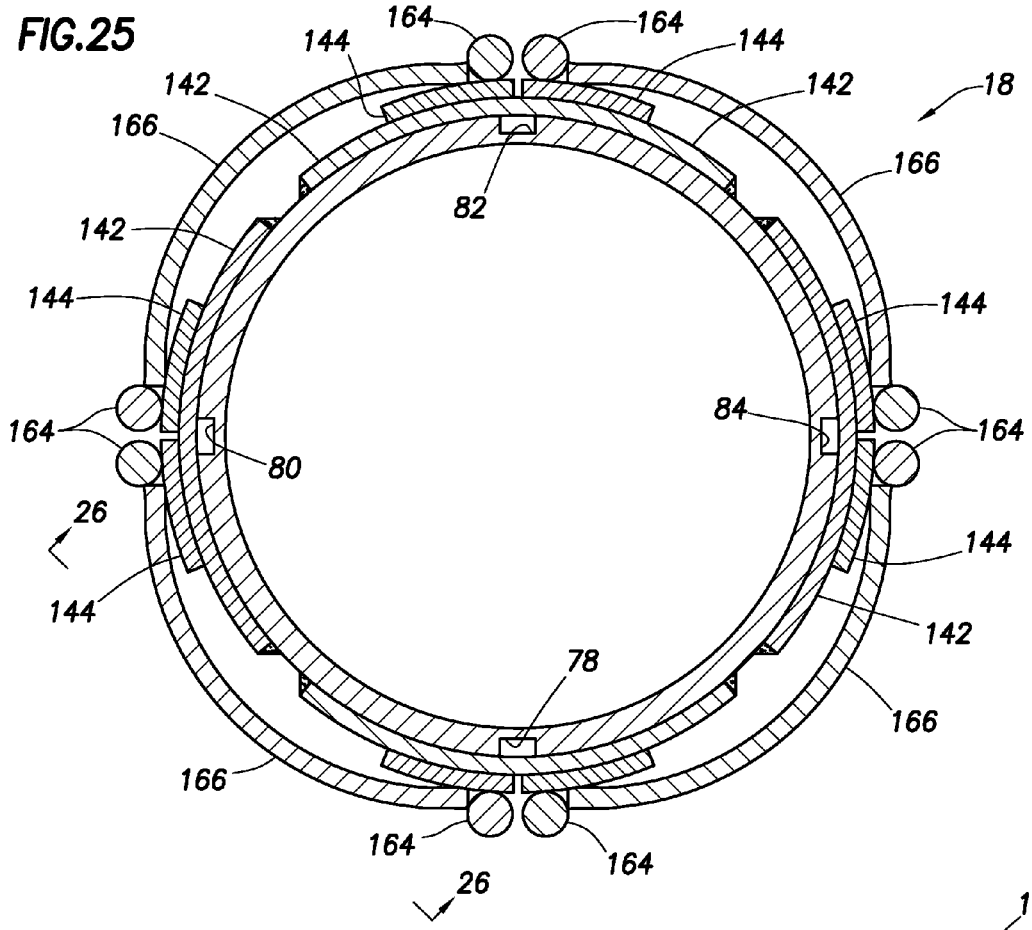
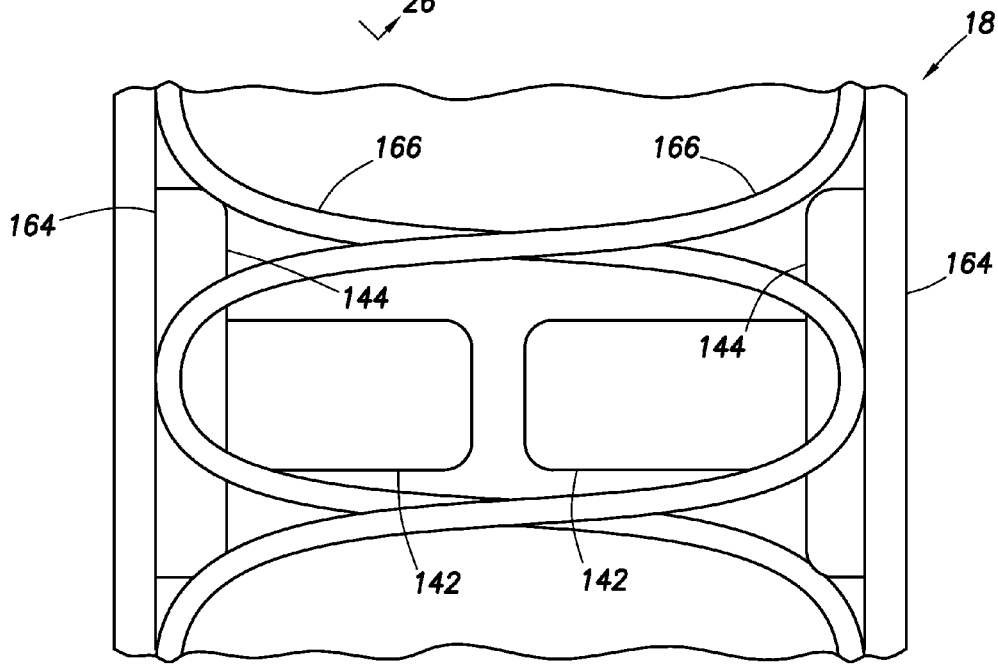
FIG.26

CASING EXPANSION AND FORMATION COMPRESSION FOR PERMEABILITY PLANE ORIENTATION

BACKGROUND

The present invention relates generally to equipment utilized and operations performed in conjunction with a subterranean well and, in an embodiment described herein, more particularly provides casing expansion and formation compression for permeability plane orientation.

It is highly desirable to be able to accurately orient planes used for increasing permeability in subterranean formations. If the increased permeability planes can be directed in predetermined orientations, then greater control is provided over the propagating operation, enhanced stimulation is obtained, and propagating and associated stimulation operations may be more economically performed.

It is known in the art to install a special injection casing in a relatively shallow wellbore to form fractures extending from the wellbore in preselected azimuthal directions. A fracturing fluid is pumped into the injection casing to simultaneously dilate the injection casing and fracture the surrounding formation. Unfortunately, this technique is not as useful when a significant overburden stress exists in the formation, since it is also known that a fracture will preferentially propagate in a fracture orthogonal to the lowest stress vector in the formation.

Therefore, it may be seen that improvements are needed in the art. It is among the objects of the present invention to provide such improvements.

SUMMARY

In carrying out the principles of the present invention, various apparatus and methods are provided which solve at least one problem in the art. One example is described below in which increased compressive stress is produced in a formation prior to propagating an increased permeability plane into the formation. Another example is described below in which reduced stresses are applied to the formation about a wellbore, and then the stresses are locally relieved to initiate propagation of an increased permeability plane.

In one aspect of the invention, a method of forming one or more increased permeability planes in a subterranean formation is provided. The method includes the steps of: installing a casing section in a wellbore intersecting the formation, and expanding the casing section in the wellbore. Then, a fluid is injected into the formation. The injecting step is performed after the expanding step is completed.

In another aspect of the invention, a method of forming one or more increased permeability planes in a subterranean formation is provided which includes the steps of: applying an increased compressive stress to the formation, the compressive stress being radially directed relative to a wellbore intersecting the formation, and then piercing the formation radially outward from the wellbore, thereby initiating the increased permeability plane.

In yet another aspect of the invention, a method of forming one or more increased permeability planes in a subterranean formation includes the steps of: applying a reduced stress to the formation, the reduced stress being directed orthogonal to a wellbore intersecting the formation, and then piercing the formation with one or more penetrations extending radially outward from the wellbore, thereby relieving the reduced stress at the penetrations.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

BRIEF DESCRIPTION OF THE DRAWINGS

FIG. 25 is an enlarged scale schematic cross-sectional view of an eighth alternate configuration of the casing section;

FIG. 26 is a schematic elevational view of the casing section of FIG. 25, viewed from line 26-26 of FIG. 25;

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
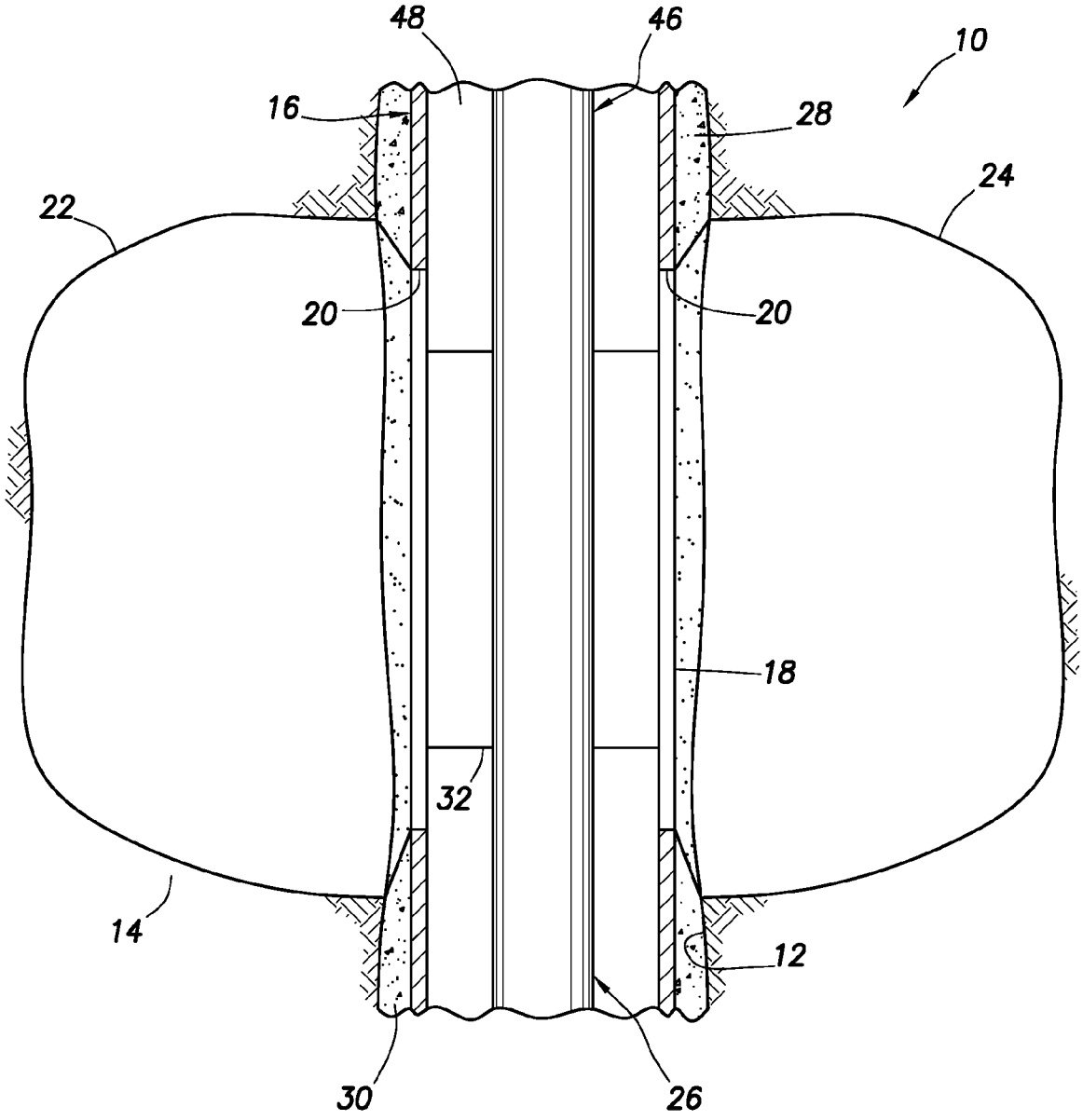
FIG. 1 is a schematic partially cross-sectional view of a well system and associated method embodying principles of the present invention.

Representatively illustrated in FIG. 1 is a well system 10 and associated method which embody principles of the present invention. A wellbore 12 has been drilled intersecting a subterranean zone or formation 14. The wellbore 12 is lined with a casing string 16 which includes a casing section 18 extending through the formation 14.

As used herein, the term "casing" is used to indicate a protective lining for a wellbore. Casing can include tubular elements such as those known as casing, liner or tubing. Casing can be substantially rigid, flexible or expandable, and can be made of any material, including steels, other alloys, polymers, etc.

As depicted in FIG. 1, longitudinally extending openings 20 are formed through a sidewall of the casing section 18. These openings 20 provide for fluid communication between the formation 14 and an interior of the casing string 16. The openings 20 may or may not exist in the casing section 18 sidewall when the casing string 16 is installed in the wellbore 12.

Increased permeability planes 22, 24 extend radially outward from the wellbore 12 in predetermined directions. These increased permeability planes 22, 24 may be formed simultaneously, or in any order. The increased permeability planes 22, 24 may not be completely planar or flat in the geometric sense, in that they may include some curved portions, undulations, tortuosity, etc., but preferably the planes do extend in a generally planar manner outward from the wellbore 12.

The planes 22, 24 may be merely planes of increased permeability relative to the remainder of the formation 14, for example, if the formation is relatively unconsolidated or poorly cemented. In some applications (such as in formations which can bear substantial principal stresses), the planes 22, 24 may be of the type known to those skilled in the art as "fractures." The increased permeability planes 22, 24 may result from relative displacements in the material of the formation 14, from washing out, etc.

The increased permeability planes 22, 24 preferably are azimuthally oriented in preselected directions relative to the wellbore 12. Although the wellbore 12 and increased permeability planes 22, 24 are vertically oriented as depicted in FIG. 1, they may be oriented in any other direction in keeping with the principles of the invention.

A tool string 26 is installed in the casing section 18. The tool string 26 is interconnected to a tubular string 46 (such as a coiled tubing string or production tubing string, etc.) used to convey and retrieve the tool string. The tool string 26 may, in various embodiments described below, be used to expand the casing section 18, form or at least widen the openings 20, form the increased permeability planes 22, 24 and/or accomplish other functions.

One desirable feature of the tool string 26 and casing section 18 is the ability to preserve a sealing capability and structural integrity of cement or another hardened fluid 28 in an annulus 30 surrounding the casing section. By preserving the sealing capability of the hardened fluid 28, the ability to control the direction of propagation of the increased permeability planes 22, 24 is enhanced. By preserving the structural integrity of the hardened fluid 28, production of debris into the casing string 16 is reduced.

To accomplish these objectives, the tool string 26 includes a casing expander 32. The casing expander 32 is used to apply certain desirable stresses to the hardened fluid 28 and formation 14 prior to propagating the increased permeability planes 22, 24 radially outward.

In this manner, a desired stress regime may be created and stabilized in the formation 14 before significant propagation of the increased permeability planes 22, 24, thereby imparting much greater directional control over the propagation of the planes. It will be readily appreciated by those skilled in the art that, especially in relatively unconsolidated or poorly cemented formations, the stress regime existing in a formation is a significant factor in determining the direction in which an increased permeability plane will propagate.

At this point it should be clearly understood that the invention is not limited in any manner to the details of the well system 10 and associated method described herein. The well system 10 and method are merely representative of a wide variety of applications which may benefit from the principles of the invention.

Figure 2:
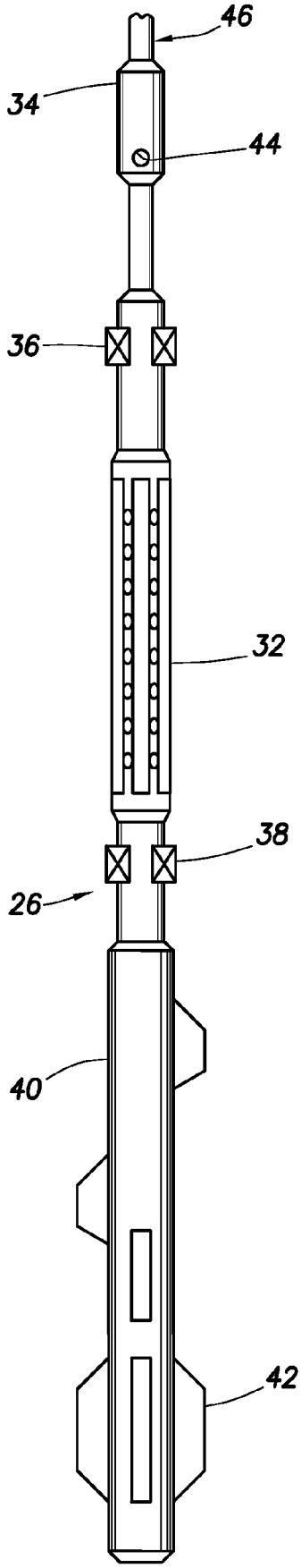
FIG. 2 is an elevational view of a tool string which may be used in the well system of FIG. 1.

Referring additionally now to FIG. 2, an elevational view of the tool string 26 is representatively illustrated apart from the remainder of the well system 10. In this view it may be seen that, in addition to the casing expander 32, the tool string 26 includes a flow control device 34, packers 36, 38 straddling the casing expander, azimuthal orienting device 40 and anchoring/locating device 42.

The flow control device 34 is used to control fluid communication in the tool string 26. For example, in one configuration used while the tubular string 46 and tool string 26 are conveyed into or retrieved from the wellbore 12, the flow control device 34 permits circulation of fluid between the interior of the tubular string and an annulus 48 (see FIG. 1) between the tubular string and the casing string 16 (e.g., via openings 44 in the flow control device).

In another configuration used to expand the casing section 18, the flow control device 34 prevents flow through the openings 44, but provides fluid communication between the interior of the tubular string 46 and the casing expander 32. Pressure applied to the tubular string 46 is thereby used to expand the casing section 18, as described more fully below.

In yet another configuration used to propagate the planes 22, 24, the flow control device 34 provides fluid communication between the interior of the tubular string 46 and ports 50, 70, 72, 74 (not visible in FIG. 2, see FIGS. 3-5) in the casing expander 32. The flow control device 34 may be further configurable to select certain orientations of the expansion of the casing section 18, and to select certain ones of the ports 50, 70, 72, 74, etc., in order to form and propagate selected individual or multiple planes 22, 24 at selected times.

Figure 32:
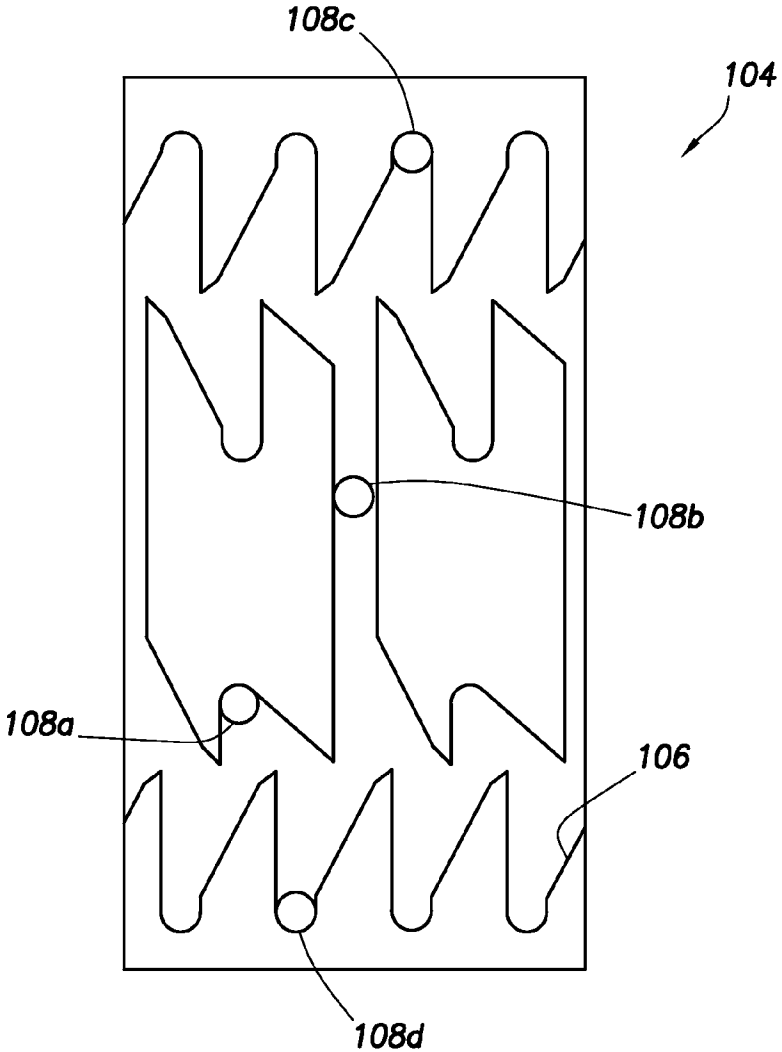
FIG. 32 is a schematic elevational view of a j-slot device which may be used in a flow control device of the tool string of FIG. 2.

A J-slot device 104 which may be included in the flow control device 34 to perform such selection functions is representatively illustrated in FIG. 32. A j-slot profile 106 of the device 104 preferably has a circumferentially extending form, but is shown "unrolled" in FIG. 32 for clarity of illustration and description.

A pin or lug 108 engages the profile 106. In FIG. 32, the lug 108 is depicted in different positions 108*a*, 108*b*, 108*c*, 108*d* corresponding to different configurations of the tool string 26. Position 108*a* is a running-in position in which the tool string 26 is run into the well and installed in the tubular string 46. In this position, the packer 38 cannot be set.

Position 108*b* is a packer setting position in which weight may be applied to set the packer 38. Position 108*c* is a port alignment position in which a passage 76 (see FIGS. 4&5) in the tool string 26 is rotationally aligned with one set (or a desired combination) of the ports 50, 70, 72, 74. Four port alignment positions are provided on the profile 106, so that each set of ports 50, 70, 72, 74 may be individually selected.

Position 108*d* is a retrieval position in which the packer 38 is unset and the tool string 26 may be retrieved from the well. Since tension will generally exist in the tool string 26 while it is being retrieved, if the packer 38 is a weight set packer, it will not be set during retrieval.

In other configurations, the flow control device 34 may provide fluid communication between the interior of the tubular string 46 and either of the packers 36, 38 to set the packers, the flow control device may provide fluid communication between the interior of the tubular string and the ports 50 to flush the interior of the casing section 18 after propagating the planes 22, 24 and stimulating the formation 14, etc. Thus, it will be appreciated that the flow control device 34 may be configured in various different ways in keeping with the principles of the invention.

The flow control device 34 may be operated by manipulation of the tubular string 46 (for example, to operate the j-slot device 104 as described above), by wired or wireless telemetry from a remote location, by application of pressure in certain sequences and/or levels to the tubular string or annulus 48, or by any other technique. For example, the flow control device 34 could be operated in a manner similar to that of circulating and tester valves used in formation testing operations and well known to those skilled in the art.

Figure 33:
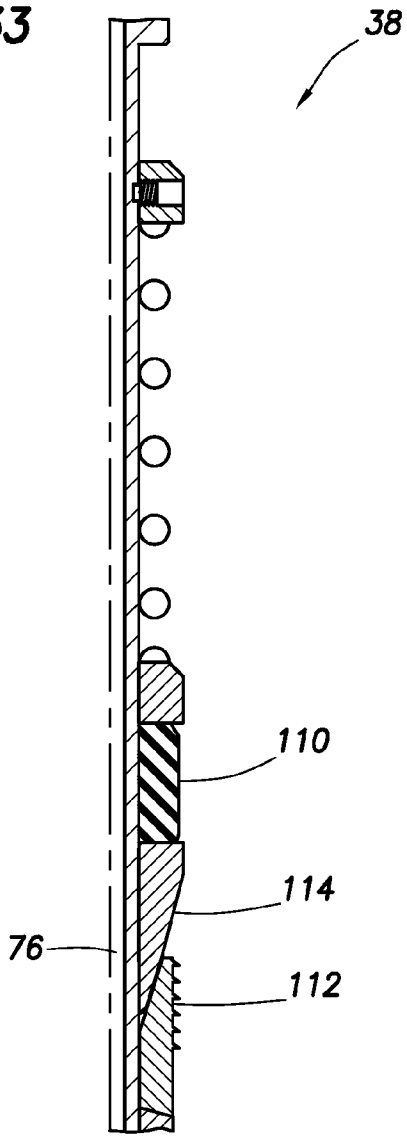
FIG. 33 is a schematic quarter-sectional view of a lower packer which may be used in the tool string of FIG. 2.

Although the packers 36, 38 could be pressure operated as described above, the upper packer 36 is preferably of the type known as a swab cup, and the lower packer 38 is preferably set by applying set-down weight via the tubular string 46. A quarter-sectional view of the lower packer 38 is representatively illustrated in FIG. 33. In this view it may be seen that the lower packer 38 includes a seal element 110, slips 112 and a wedge 114.

When set-down weight is applied to the lower packer 38, the seal element 110 is compressed and extended radially outward into sealing engagement with the casing section 18, and the slips 112 are displaced radially outward by the wedge 114 into gripping engagement with the casing section.

The orienting and anchoring/locating devices 40, 42 are used to rotationally and longitudinally align the tool string 26 with the casing section 18. The orienting device 40 may be used to engage a rotationally orienting profile in the casing string 16 in order to azimuthally orient the tool string 26, and the anchoring/locating device 42 may be used to engage a locating profile in the casing string to axially align the tool string within the casing section 18. For example, the orienting and anchoring/locating devices 40, 42 may be similar to those utilized in conjunction with the Sperry Latch Coupling used to align a whipstock or completion deflector with a window formed in a casing string in multilateral operations.

Figure 34:
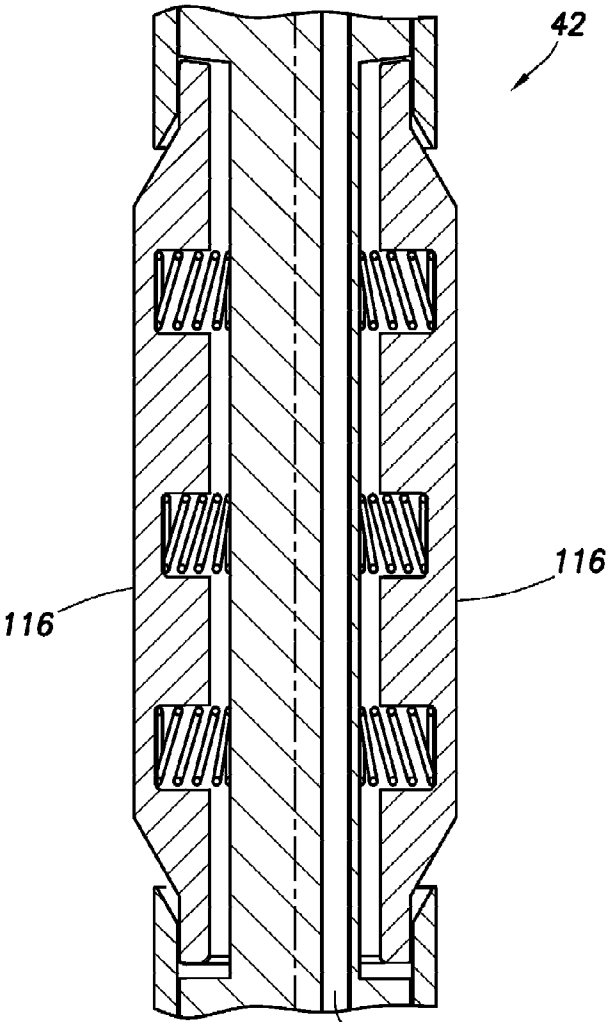
FIG. 34 is a schematic cross-sectional view of an anchoring/locating device which may be used in the tool string of FIG. 2.

An example of the anchoring/locating device 42 is representatively illustrated in FIG. 34. In this view it may be seen that the device 42 includes multiple spring-loaded keys 116. The keys 116 will snap into a corresponding profile in the casing string 16. Preferably, a force of approximately five thousand pounds is required to displace the keys out of engagement with the profile.

Figure 35:
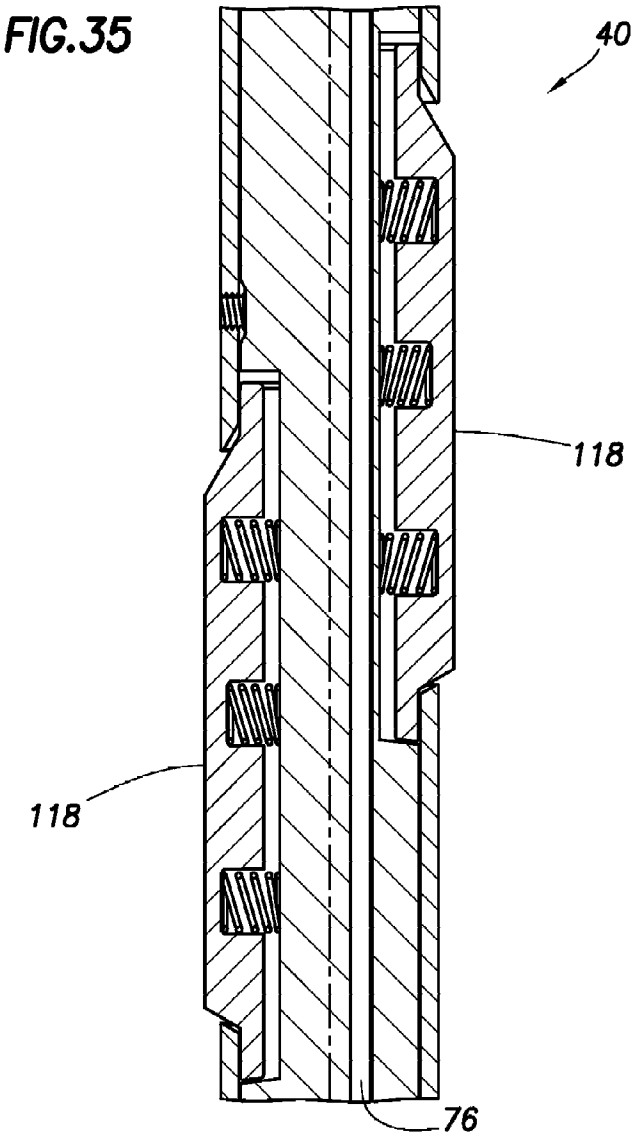
FIG. 35 is a schematic cross-sectional view of an orienting device which may be used in the tool string of FIG. 2.

An example of the orienting device 40 is representatively illustrated in FIG. 35. The device 40 is similar in some respects to the device 42 described above, at least in that it includes spring-loaded keys 118 for profile engagement in the casing string 16.

However, the keys 118 are arranged in a specific rotational pattern which corresponds with additional profiles in the casing string 16 (e.g., above the profile engaged by the anchoring/locating device 42) having a matching rotational pattern. To anchor and rotationally align the tool string 26 with the casing section 18, the keys 116 of the anchoring/locating device 42 are first engaged with their corresponding profile to maintain the appropriate axial alignment, and then the tool string 26 is rotated until the keys 118 engage their corresponding profile to obtain rotational alignment.

Figure 3:
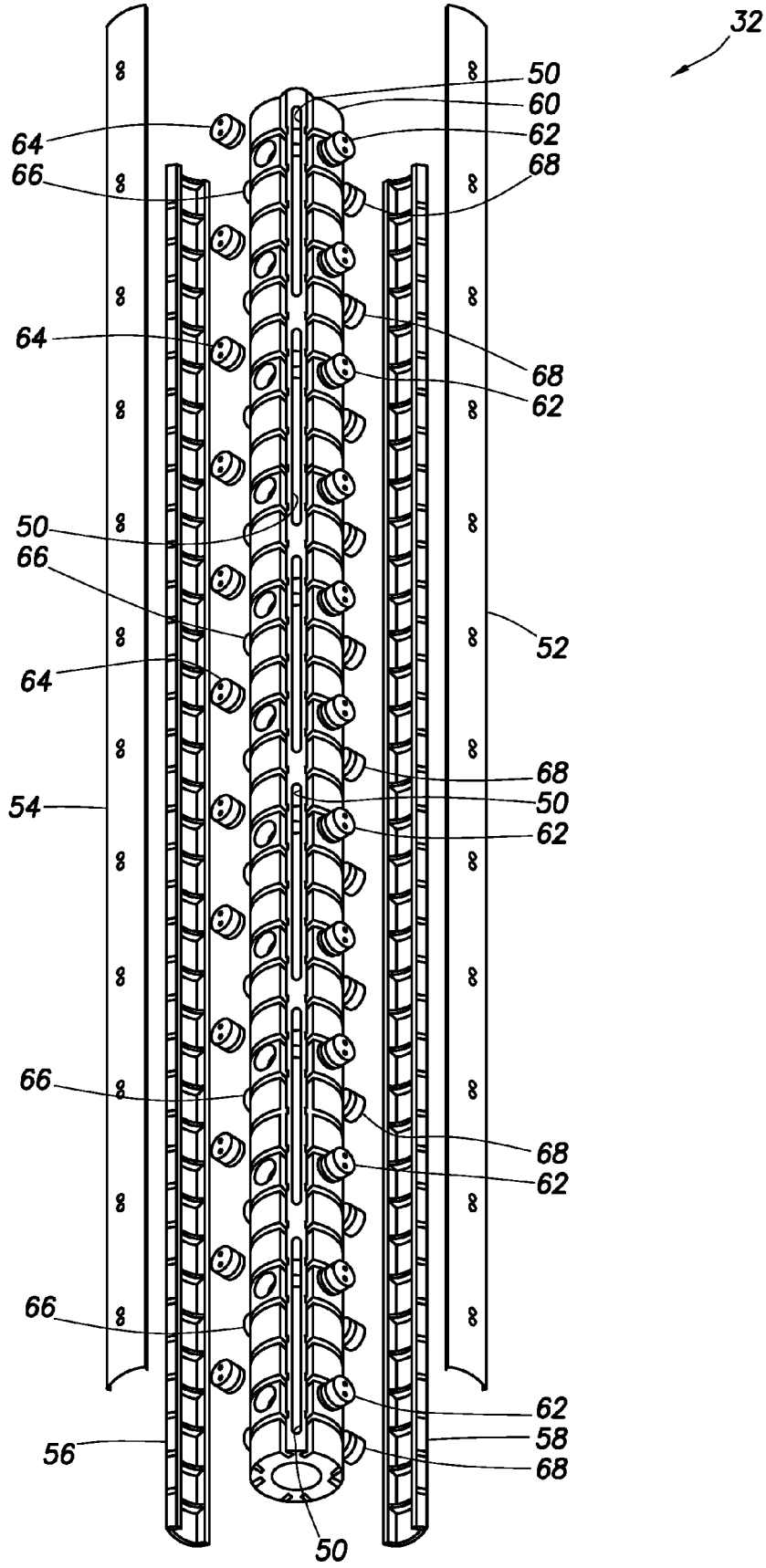
FIG. 3 is an enlarged scale exploded isometric view of a casing expander of the tool string of FIG. 2.

Referring additionally now to FIG. 3, an enlarged scale exploded view of the casing expander 32 is representatively illustrated apart from the remainder of the tool string 26. In this view it may be seen that the casing expander 32 includes multiple elongated and longitudinally extending casing engagement pads 52, 54, 56, 58 arranged about a central generally tubular mandrel 60 in which the ports 50, 70, 72, 74 are formed.

The pads 52, 54, 56, 58 are extended radially outward relative to the mandrel 60 by means of respective pistons 62, 64, 66, 68 received in the mandrel. The flow control device 34 may be used to control application of pressure to selected ones of the pistons 62, 64, 66, 68 to thereby extend or retract the respective pad(s) 52, 54, 56, 58.

Figure 36:
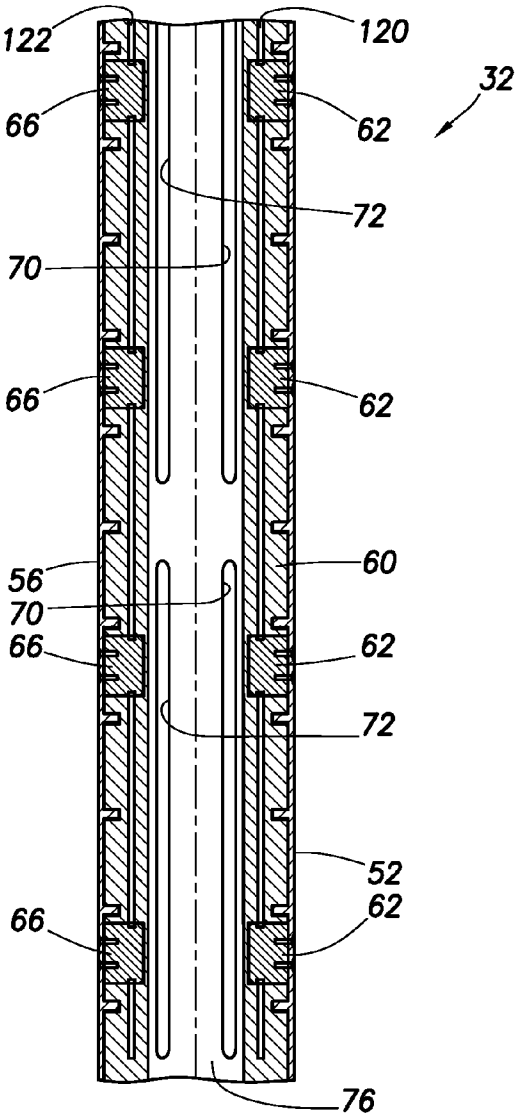
FIG. 36 is a schematic cross-sectional view of a longitudinal portion of the casing expander of FIG. 3.

In FIG. 36 a cross-sectional view of the casing expander 32 is representatively illustrated. In this view it may be seen that passages 120, 122 formed in the mandrel 60 provide fluid communication between the flow control device 34 and the respective pistons 62, 66. Similar passages 124, 126 (not visible in FIG. 36, see FIG. 5) are formed in the mandrel 60 to provide fluid communication between the flow control device 34 and the pistons 64, 68. In this manner, the flow control device 34 can selectively apply pressure to different ones or combinations of the pistons 62, 64, 66, 68 as desired.

Figure 4:
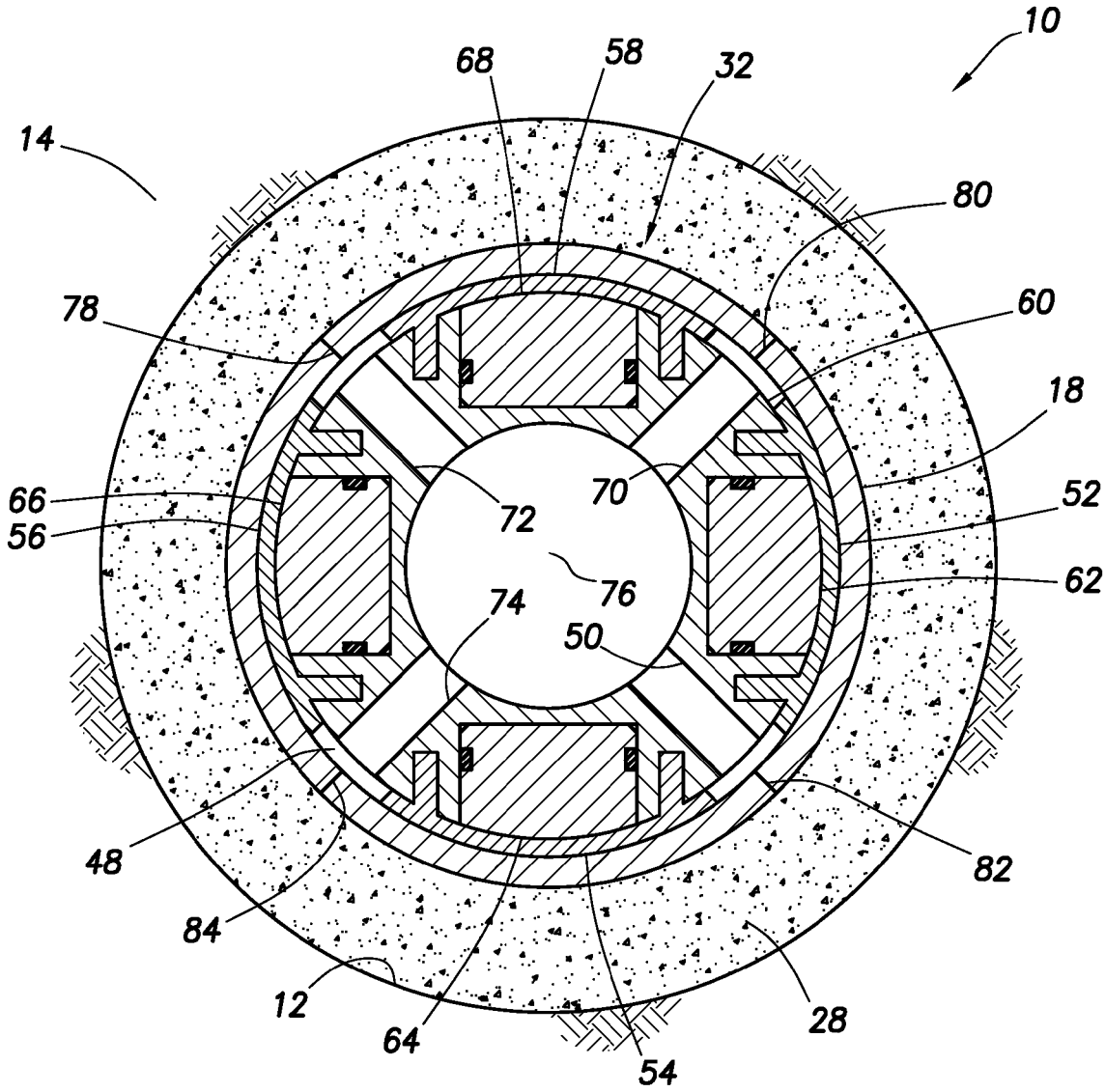
FIG. 4 is an enlarged scale cross-sectional view of the casing expander installed in casing in the well system of FIG. 1.

Referring additionally now to FIG. 4, an enlarged scale schematic cross-sectional view of the casing expander 32 installed in the casing section 18 in the well system 10 is representatively illustrated. In this view it may be seen that, in addition to the ports 50, the casing expander 32 also includes the ports 70, 72, 74 providing fluid communication between the annulus 48 and a longitudinally extending passage 76 in the mandrel 60.

In this view it may also be seen that the casing section 18 preferably includes longitudinally extending weakened portions 78, 80, 82, 84. In a manner described more fully below, the weakened portions 78, 80, 82, 84 permit the casing section 18 to be readily expanded radially outward while providing openings 20, 86 through the casing sidewall in preselected azimuthal directions.

One function of the orienting and locating/anchoring devices 40, 42 is to rotationally and axially align the casing expander 32 with the weakened portions 78, 80, 82, 84 of the casing section 18. As depicted in FIG. 4, the casing expander 32 is rotationally aligned so that the weakened portion 78 is positioned circumferentially between the pads 56, 58, the weakened portion 80 is positioned circumferentially between the pads 58, 52, the weakened portion 82 is positioned circumferentially between the pads 52, 54, and the weakened portion 84 is positioned circumferentially between the pads 54, 56. In addition, the ports 50 are radially aligned with the weakened portion 82, the ports 70 are radially aligned with the weakened portion 80, the ports 72 are radially aligned with the weakened portion 78, and the ports 74 are radially aligned with the weakened portion 84.

Although the casing section 18 and casing expander 32 are described herein as including four sets each of the ports 50, 70, 72, 74, pads 52, 54, 56, 58, pistons 62, 64, 66, 68 and weakened portions 78, 80, 82, 84, it should be clearly understood that any number of these elements may be used in keeping with the principles of the invention. Using four sets of these elements conveniently provides 90 degree phasing between the planes which will be created in the formation 14, but it will be readily appreciated that other numbers of these elements may be used to produce other phasings, such as 180 degree phasing using two sets of these elements, 60 degree phasing using six sets of these elements, 45 degree phasing using eight sets of these elements, etc.

Figure 5:
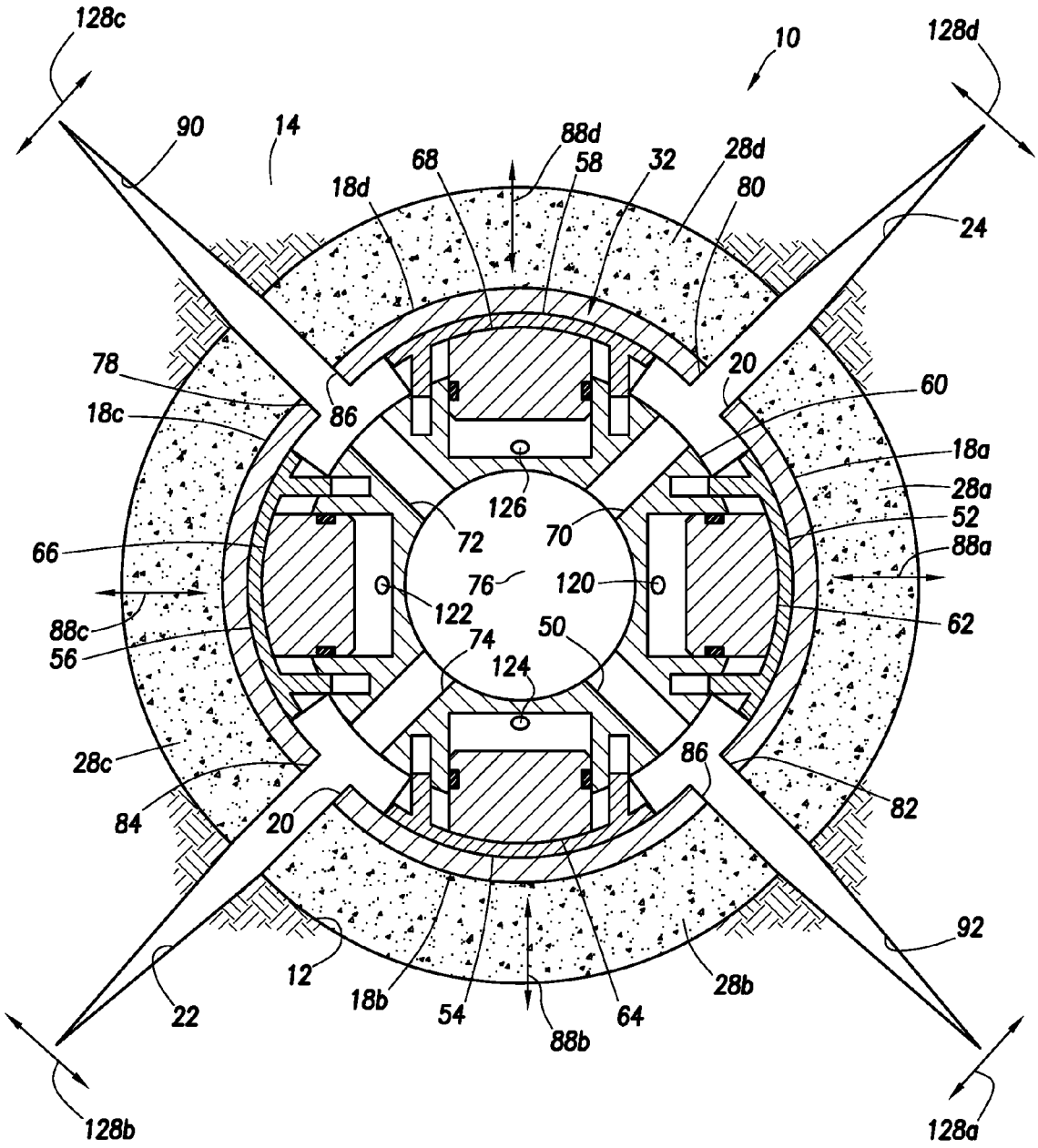
FIG. 5 is a cross-sectional view of the casing expander in an expanded configuration.

Referring additionally now to FIG. 5, the casing expander 32 and casing section 18 are representatively illustrated after the casing section has been expanded. In this view it may be seen that the casing section 18 has been thereby separated into four circumferentially separated portions 18*a*, 18*b*, 18*c*, 18*d* with longitudinally extending openings 20, 86 between the separated portions.

The hardened fluid 28 is also separated into four portions 28*a*, 28*b*, 28*c*, 28*d*. In a desirable feature of the casing expander 32, radially directed increased compressive stresses 88*a*, 88*b*, 88*c*, 88*d* are applied by the casing expander 32 to the respective hardened fluid portions 28*a*, 28*b*, 28*c*, 28*d*, and thereby to the surrounding formation 14, by the casing expander.

To accomplish this result, the flow control device 34 is used to direct fluid pressure to the pistons 62, 64, 66, 68 to bias the pads 52, 54, 56, 58 radially outward. It is not necessary, however, for all of the pads 52, 54, 56, 58 to be simultaneously biased by the pistons 62, 64, 66, 68.

For example, the flow control device 34 could direct fluid pressure only to selected ones or combinations of the pistons 62, 64, 66, 68 to thereby bias only selected ones or combinations of the pads 52, 54, 56, 58 radially outward. Later, other selected ones or combinations of the pistons 62, 64, 66, 68 could be provided with fluid pressure to thereby bias corresponding other selected ones or combinations of the pads 52, 54, 56, 58 radially outward. Thus, it will be appreciated that any combination and sequence of the pistons 62, 64, 66, 68 may be supplied with fluid pressure to bias any corresponding combination and sequence of the pads 52, 54, 56, 58 outward at any time.

As depicted in FIG. 5, all of the ports 50, 70, 72, 74 provide fluid communication between the passage 76 and the respective openings 20, 86. However, it will be appreciated that the flow control device 34 could be configured to permit fluid communication between only selected ones or combinations of the ports 50, 70, 72, 74 and the passage 76 (or another passage in communication with the interior of the tubular string 46).

With the casing section portions 18*a*, 18*b*, 18*c*, 18*d* and hardened fluid portions 28*a*, 28*b*, 28*c*, 28*d* separated as illustrated in FIG. 5, the openings 20, 86 widened, and the compressive stresses 88*a-d* applied to the formation 14, a desirable stress regime is thereby created in the formation. The increased permeability planes 22, 24, 90, 92 may then be propagated radially outward in desired preselected azimuthal directions by applying fluid pressure thereto via the ports 50, 70, 72, 74.

Of course, if only certain ones or combinations of the pads 52, 54, 56, 58 and pistons 62, 64, 66, 68 are displaced radially outward, then only corresponding ones of the openings 20, 86 may be opened, and so only corresponding ones of the planes 22, 24, 90, 92 may be propagated by applying fluid pressure via only corresponding ones of the ports 50, 70, 72, 74. It is a particular beneficial feature of the tool string 26 that the flow control device 34 and casing expander 32 may be used to apply any one or combination of the compressive stresses 88*a-d* to the formation 14, radially outwardly displace any one or combination of the pads 52, 54, 56, 58 and pistons 62, 64, 66, 68, widen any one or combination of the openings 20, 86, propagate any one or combination of the increased permeability planes 22, 24, 90, 92, and apply pressure to any one or combination of the openings 20, 86 via any one or combination of the ports 50, 70, 72, 74 as desired.

Once a desired one or combination of openings 20, 86 are widened and compressive stresses 88*a-d* are applied, fluid pressure applied to the respective one or combination of pistons 62, 64, 66, 68 is preferably maintained using the flow control device 34 (e.g., by trapping the applied pressure in the casing expander 32). In this manner, the compressive stresses 88*a-d* are maintained in the hardened fluid portions 28*a*, 28*b*, 28*c*, 28*d* and formation 14 during subsequent operations.

Maintaining the compressive stresses 88*a-d* in the hardened fluid portions 28*a*, 28*b*, 28*c*, 28*d* during propagation of the planes 22, 24, 90, 92 and stimulation of the formation 14 helps to maintain a seal between the hardened fluid and the casing section 18, and between the hardened fluid and the wellbore 12, thereby preventing undesirable flow of propagating or stimulation fluid to unintended locations along the wellbore.

Maintaining the compressive stresses 88*a-d* in the formation during propagation of the increased permeability planes 22, 24, 90, 92 helps to control the directions in which the planes propagate. That is, since increased compressive stress is thereby created in a radial direction relative to the wellbore 12, the increased permeability planes 22, 24, 90, 92 are also thereby influenced against propagating in a direction tangential to the wellbore (i.e., in a direction orthogonal to the increased compressive stresses 88*a-d*).

Assuming a substantial overburden pressure generating a compressive stress in a vertical direction orthogonal to the compressive stresses 88*a*, 88*b*, 88*c*, 88*d* and greater than localized horizontal compressive stress in the formation 14 orthogonal to the compressive stresses 88*a*, 88*b*, 88*c*, 88*d* (i.e., tangential to the wellbore 12), the minimum compressive stress in the formation will be orthogonal to the desired azimuthal directions of the planes 22, 24, 90, 92. Indeed, localized reduced stresses 128*a*, 128*b*, 128*c*, 128*d* are preferably applied by the casing expander 32 to the formation 14 and, as discussed above, the increased permeability planes 22, 24, 90, 92 will propagate orthogonal to these reduced stresses.

Of course, few wellbores are exactly vertical and few formations are completely homogenous, etc., and so it may be desirable in particular circumstances to vary certain ones or combinations of the increased compressive stresses 88*a*, 88*b*, 88*c*, 88*d* and reduced stresses 128*a*, 128*b*, 128*c*, 128*d* to thereby produce a corresponding desired stress regime in the formation 14 to direct the propagation of the planes 22, 24, 90, 92 in corresponding desired azimuthal directions relative to the wellbore 12. It is a particular benefit of the tool string 26, including the flow control device 34 and the casing expander 32, that this level of control is provided over the level of application of each of the increased compressive stresses 88*a-d*, reduced stresses 128*a-d* and the corresponding direction of propagation of the increased permeability planes 22, 24, 90, 92.

Note that the desired stress regime is preferably created in the formation 14 prior to any significant propagation of the planes 22, 24, 90, 92. This permits the stresses 88*a-d*, 128*a-d* to be precisely regulated and stabilized in the formation 14 before significant propagation of the increased permeability planes 22, 24, 90, 92, thereby affording an increased level of control over the direction of propagation of each of the planes.

However, it will be appreciated that, when the openings 20, 86 are widened and the casing section portions 18*a*, 18*b*, 18*c*, 18*d* and hardened fluid portions 28*a*, 28*b*, 28*c*, 28*d* are separated, some initiation of the increased permeability planes 22, 24, 90, 92 may occur. Nevertheless, significant propagation of the planes 22, 24, 90, 92 should only occur when fluid pressure is applied via the ports 50, 70, 72, 74, and preferably after expansion of the casing section 18.

Figure 40:
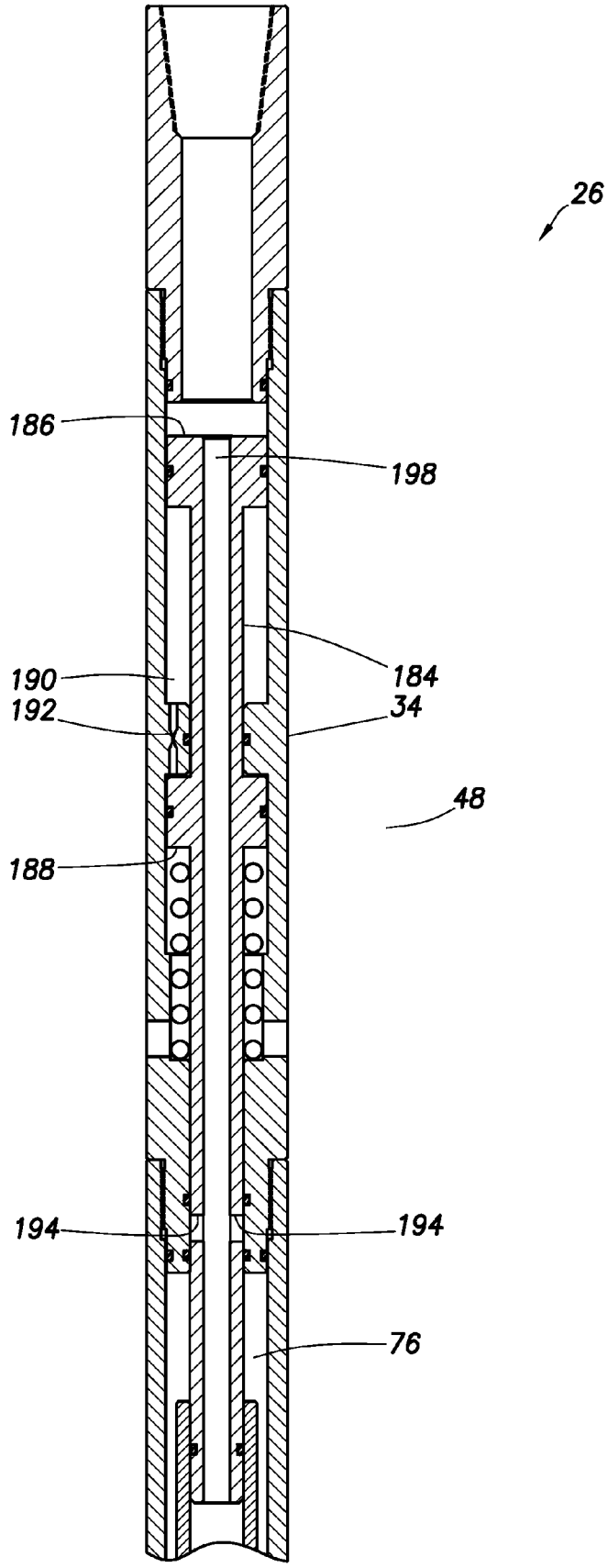
FIG. 40 is a schematic cross-sectional view of an alternate configuration of the tool string of FIGS. 2-5.

In FIG. 40 is representatively illustrated an alternate configuration of the tool string 26 in which the flow control device 34 is configured to accomplish this desirable result. When pressure is applied to the tool string 26 via the tubular string 46, a piston assembly 184 of the flow control device 34 begins to displace downward. This is due to a pressure differential applied across the piston assembly 184 resulting from pressure in the tubular string 46 being applied to an upper piston end 186 of the piston assembly, and pressure in the annulus 48 being applied to a lower piston end 188 of the assembly.

Downward displacement of the piston assembly 184 is slowly metered by restricted flow of a hydraulic fluid 190 through an orifice 192. During this displacement of the piston assembly 184, pressurized fluid is delivered through a passage 198 to the pistons 62, 64, 66, 68 (for example, via the passages 120, 122, 124, 126) to outwardly bias the pads 52, 54, 56, 58 and expand the casing section 18. Any of the configurations of a pressure intensifier 130 described below may be used between the passage 198 and the passages 120, 122, 124, 126, if desired.

Eventually, openings 194 in the piston assembly 184 are exposed to the passage 76 which is in communication with the ports 50, 70, 72, 74. At this point, the pressurized fluid is delivered to the ports 50, 70, 72, 74 for injection into the formation 14 via the openings 20, 86 and propagation of the increased permeability planes 22, 24, 90, 92.

Preferably, the fluid used to apply pressure to the pistons 62, 64, 66, 68 and thereby apply the compressive stresses 88*a-d* and reduced stresses 128*a-d* to the formation 14 is different from the fluid subsequently flowed via the ports 50, 70, 72, 74 into the planes 22, 24, 90, 92 to propagate the planes radially outward. For example, the flow control device 34 may be operated to apply an appropriate fluid (such as brine or another completion fluid) from the tubular string 46 to the pistons 62, 64, 66, 68 to outwardly bias the pads 52, 54, 56, 58, then the flow control device may be operated to trap this fluid in the casing expander 32 to maintain the increased compressive stresses 88*a-d* and reduced stresses 128*a-d* in the formation 14, then the flow control device may be operated to circulate an appropriate propagating and/or stimulation fluid (such as a proppant slurry, acid mixture, gels, breakers, etc.) via the tubular string to the tool string 26, and then the flow control device may be operated to shut off circulation and apply the propagating and/or stimulation fluid from the tubular string via the ports 50, 70, 72, 74 to the increased permeability planes 22, 24, 90, 92.

After the propagating and/or stimulation operations are completed, the flow control device 34 may be operated to circulate fluid about the tool string 26 (to, for example, flush proppant from the wellbore 12 about the tool string), and the flow control device may be operated to relieve the pressure applied to the pistons 62, 64, 66, 68, thereby allowing the pads 52, 54, 56, 58 to retract radially inward, so that the tool string may be conveniently retrieved from the wellbore. Alternatively, multiple such operations (casing expansion and propagation of planes) may be performed using the tool string 26 during a single trip of the tool string into the wellbore 12.

Figure 6A:
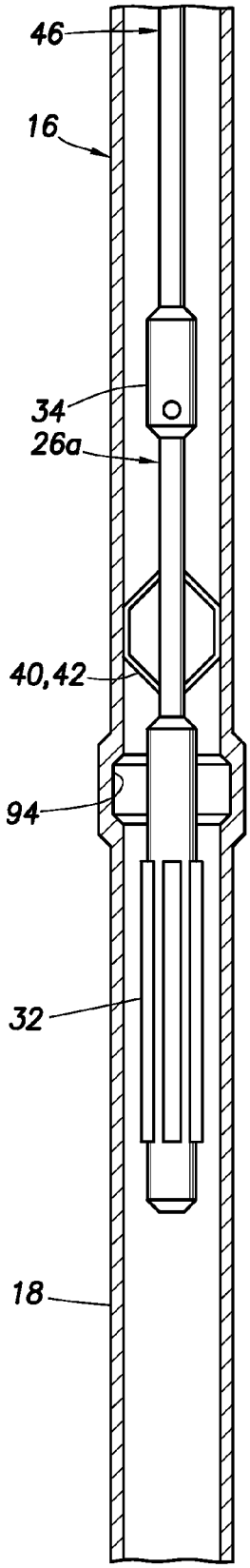
FIGS. 6A-C are reduced scale schematic partially cross-sectional views of a first alternate configuration of the tool string and associated method, showing a sequence of steps in the method.
Figure 6B:
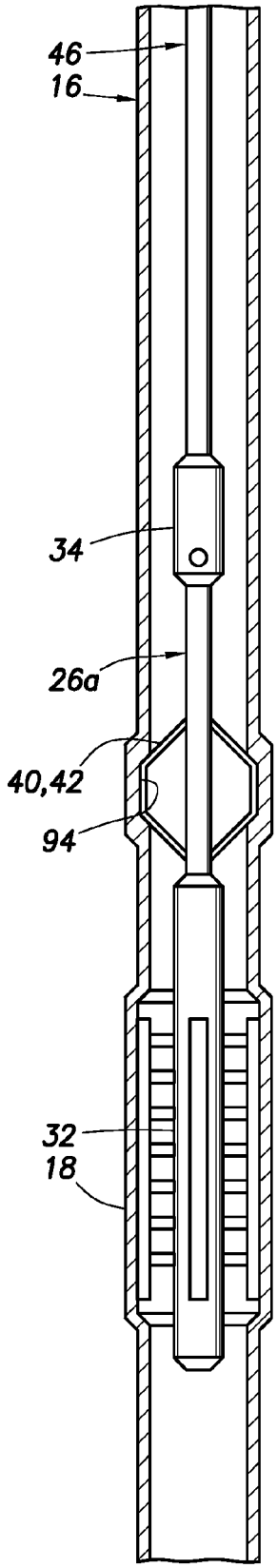
Figure 6C:
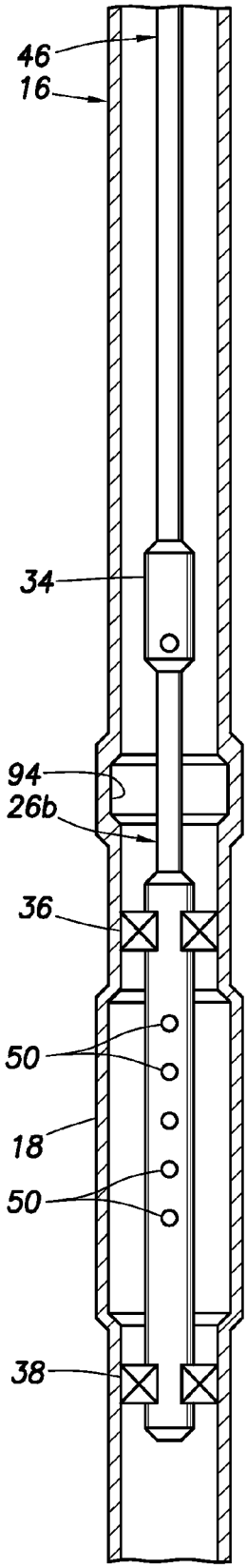

Referring additionally now to FIGS. 6A-C, a reduced scale schematic view of an alternate configuration of the tool string 26 is representatively illustrated positioned in the casing string 16 apart from the remainder of the well system 10. The tool string 26 of FIGS. 6A-C is different from the tool string described above in at least one substantial respect, in that multiple trips and corresponding different configurations of the tool string are used to separately expand the casing section 18 and propagate the increased permeability planes 22, 24, 90, 92.

An initial tool string 26*a* is depicted in FIGS. 6A&B, and a subsequent tool string 26*b* is depicted in FIG. 6C. The initial tool string 26*a* includes the casing expander 32, flow control device 34 and an alternate configuration of the orienting and locating/anchoring devices 40, 42.

The orienting and locating/anchoring devices 40, 42 are used to engage an orienting profile 94 in the casing string 16 to thereby rotationally orient and axially align the tool string 26*a* relative to the casing section 18. In FIG. 6B, it may be seen that the tool string 26*a* is positioned properly in the casing string 16, and the casing expander 32 has been operated to expand the casing section 18.

The casing expander 32 as depicted in FIGS. 6A-C is different from the casing expander of FIGS. 2-5, at least in that the ports 50, 70, 72, 74 are not provided in the casing expander. Note, also, that the packers 36, 38 do not straddle the casing expander 32. Instead, the ports 50, 70, 72, 74 and packers 36, 38 are provided in the subsequent tool string 26*b* depicted in FIG. 6C.

After the casing section 18 has been expanded as shown in FIG. 6B, the initial tool string 26*a* is retrieved and the subsequent tool string 26*b* is installed. The packers 36, 38 straddle the expanded casing section 18 and the flow control device 34 is operated to communicate fluid pressure from the interior of the tubular string 46 to the openings 20, 86 to propagate the planes 22, 24, 90, 92 (not shown in FIG. 6C). The orienting and locating/anchoring devices 40, 42 could be used in the subsequent tool string 26*b* to align the tool string with the expanded casing section 18, if desired.

Referring additionally now to FIGS. 7A-E, an enlarged scale schematic cross-sectional view of the initial tool string 26*a* is representatively illustrated installed in the casing string 16 apart from the remainder of the well system 10. In this view it may be seen that this configuration of the flow control device 34 includes a pressure intensifier 130 for increasing the pressure available to expand the casing section 18.

The pressure intensifier 130 includes a series of pistons 96, 98, 100 configured to multiply the pressure differential between the interior of the tubular string 46 and the annulus 48. An upper floating piston 102 isolates fluid applied to the pistons 62, 64, 66, 68, 96, 98, 100 from fluid in the tubular string 46 above the tool string 26.

As will be appreciated by those skilled in the art, the pistons 96, 98, 100 operate to increase the pressure applied from the interior of the tubular string 46 to the passage 76 due to the differential areas formed on the pistons. Springs 104, 106, 108 bias the pistons 96, 98, 100 upwardly to allow the pistons 62, 64, 66, 68 to retract when pressure applied to the interior of the tubular string 46 is relieved.

Figure 37A:
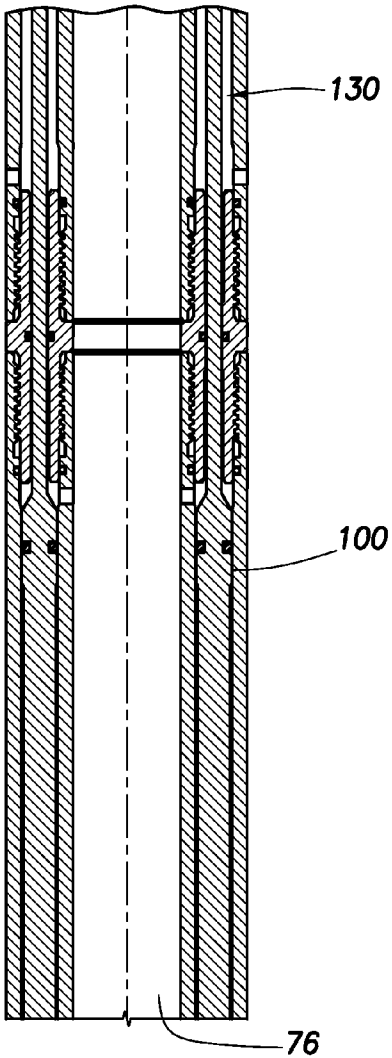
FIGS. 37A&B are schematic cross-sectional views of successive axial portions of an alternate configuration of a pressure intensifier.

An alternate configuration of the pressure intensifier 130 is representatively illustrated in FIGS. 37A&B. The configuration of FIGS. 37A&B is especially suited for use with the tool string 26 configuration of FIGS. 2-5, since the passage 76 remains available for delivery of fluid to propagate the increased permeability planes 22, 24, 90, 92 and stimulate the formation 14 after the casing section 18 has been expanded.

For this purpose, in the pressure intensifier 130 of FIGS. 37A&B, the pistons 96, 98, 100 (only one of which is visible in FIGS. 37A&B) are annular shaped. However, the principle of operation remains the same as the configuration of FIG. 7A-E, in that the differential areas on the pistons 96, 98, 100 result in a multiplying of the pressure applied to the tool string 26.

Figure 37B:
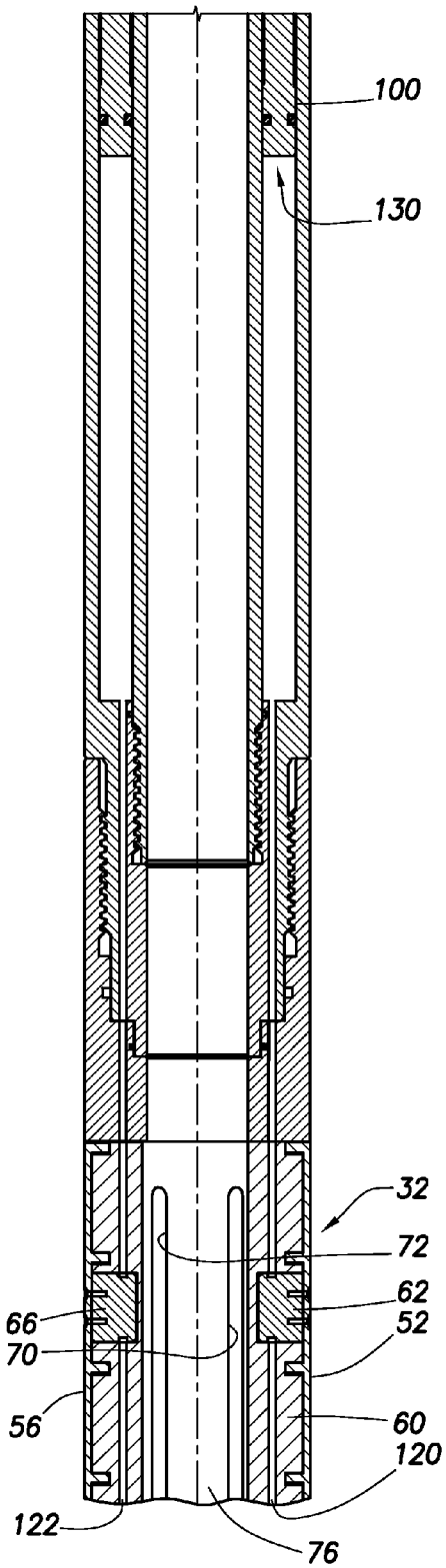

Note that, in FIG. 37B, the passages 120, 122, 124, 126 are connected directly to the pressure intensifier 130 for biasing the pistons 62, 64, 66, 68 radially outward. However, as described above, the flow control device 34 may include features (such as valves, etc.) which allow pressure to be applied to selected ones or combinations of the pistons 62, 64, 66, 68.

Figure 38:
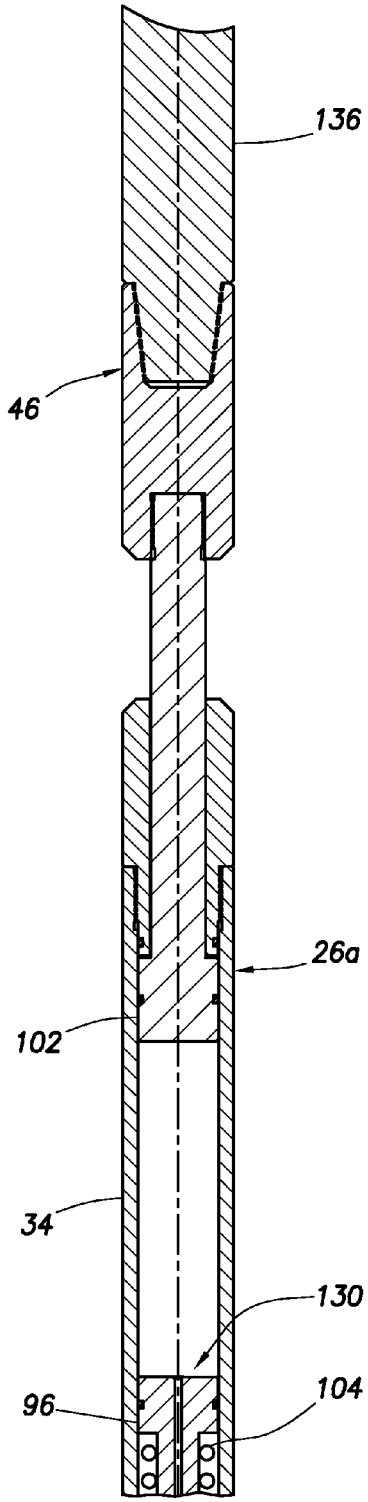
FIG. 38 is a schematic cross-sectional view of an alternate configuration of a flow control device for use with the tool string configuration of FIGS. 7A-E.

Referring additionally now to FIG. 38, another alternate configuration of the flow control device 34 and pressure intensifier 130 is representatively illustrated. This configuration is especially suited for use with the initial tool string 26*a* configuration of FIGS. 7A-E, but with appropriate modification could be used with the tool string 26 of FIGS. 2-5.

Instead of applying fluid pressure to the floating piston 102 via the tubular string 46, in the configuration of FIG. 38, weight is applied from the tubular string to the piston. A weight collar 136 may be included in the tubular string 46 for this purpose.

The weight applied to the piston 102 results in pressure being applied to the piston 96 and the other pistons 98, 100 (not visible in FIG. 38, see FIGS. 7B&C) to thereby multiply the pressure applied to the passage 76. Thus, it will be appreciated that any method may be used to apply fluid pressure to the passage 76 to expand the casing section 18 in keeping with the principles of the invention.

Referring again to FIG. 7E, note that the anchoring/locating device 42 in this configuration of the initial tool string 26*a* includes slips 132 attached to pistons 134 in communication with the passage 76. Thus, when pressurized fluid is applied to the passage 76 (for example, to propagate the planes 22, 24, 90, 92, stimulate the formation 14, etc.), the pistons 134 are biased radially outward, thereby causing the slips 132 to grippingly engage the casing string 16.

Figure 7A:
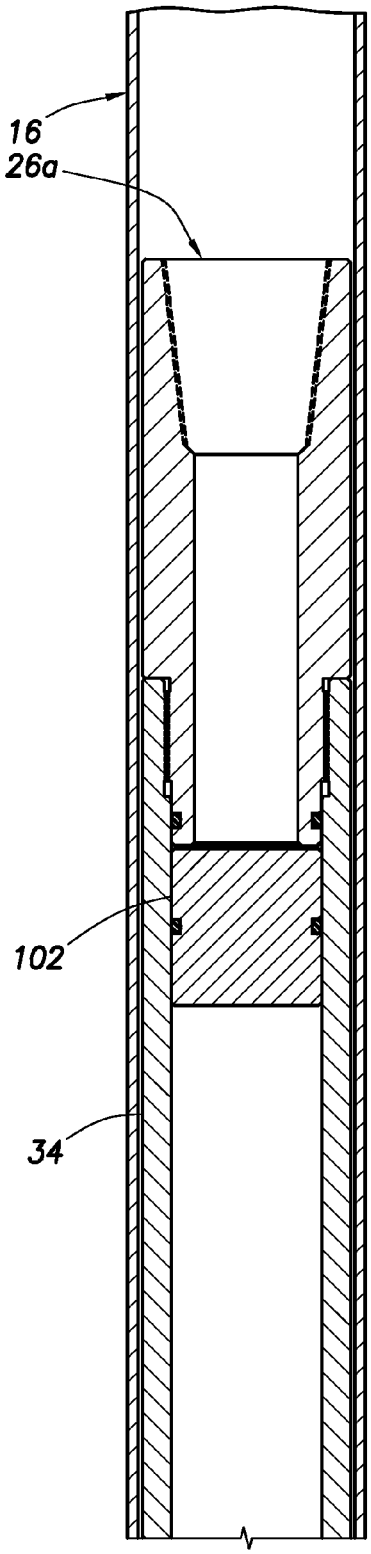
FIGS. 7A-E are enlarged scale schematic cross-sectional views of successive axial sections of a first alternate configuration of the casing expander.
Figure 7B:
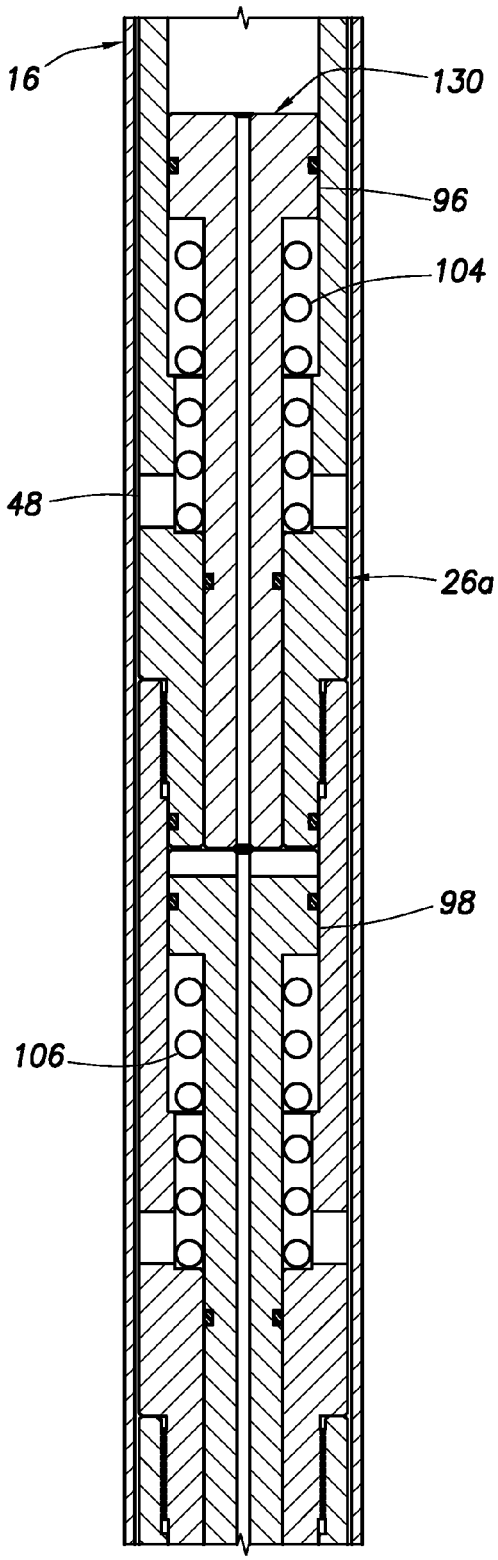
Figure 7C:
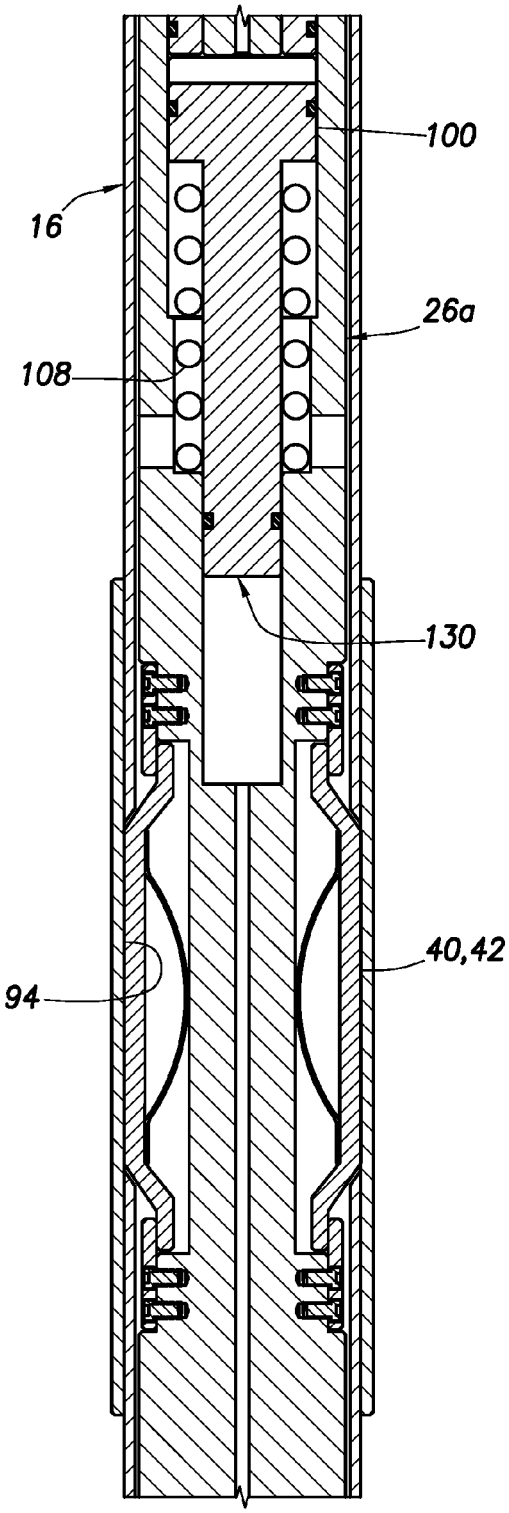
Figure 7D:
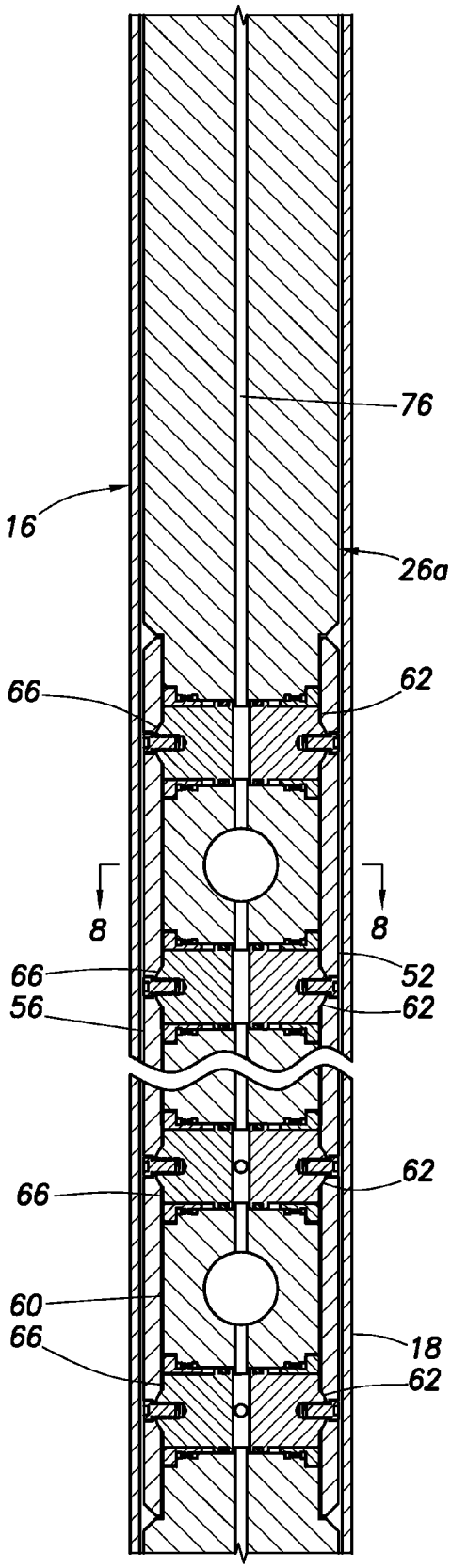
Figure 7E:
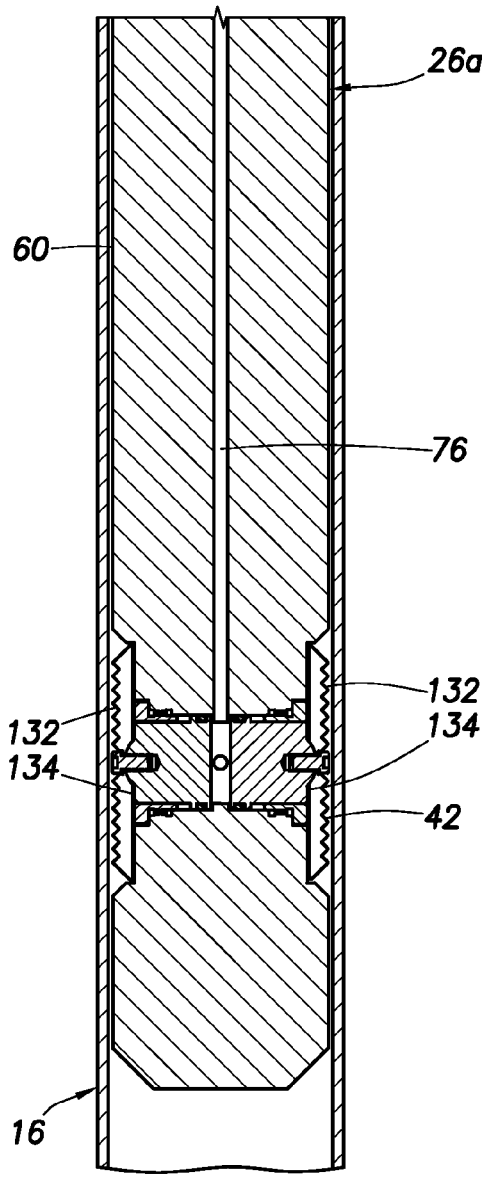
Figure 8:
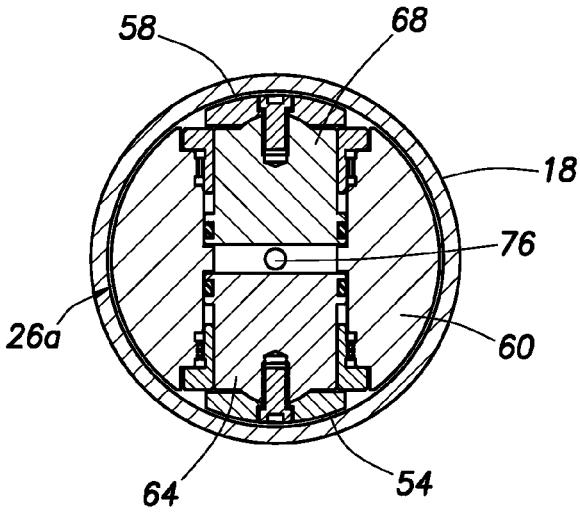
FIG. 8 is a cross-sectional view of the casing expander of FIGS. 7A-E, taken along line 8-8 of FIG. 7D.

Referring additionally now to FIG. 8, a cross-sectional view of the initial tool string 26*a* is representatively illustrated, taken along line 8-8 of FIG. 7D. In this view the orientation of the pistons 64, 68 in the mandrel 60 relative to the pistons 62, 66 visible in FIG. 7D may be clearly seen.

Figure 9A:
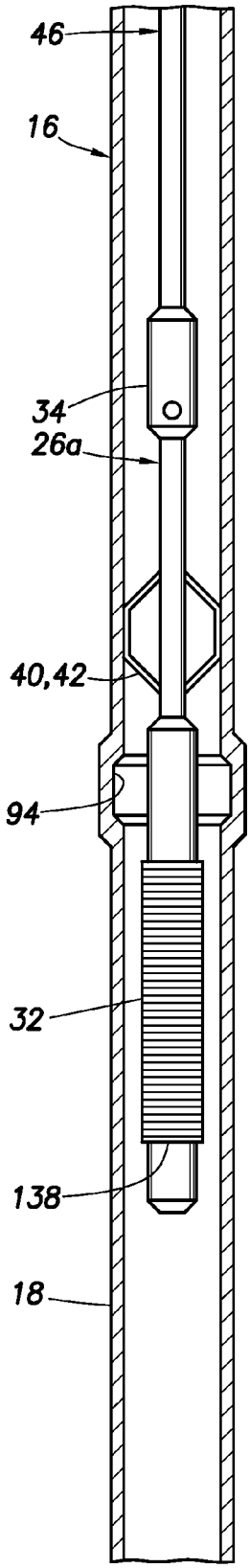
FIGS. 9A-C are reduced scale schematic partially cross-sectional views of a second alternate configuration of the tool string and associated method, showing a sequence of steps in the method.
Figure 9B:
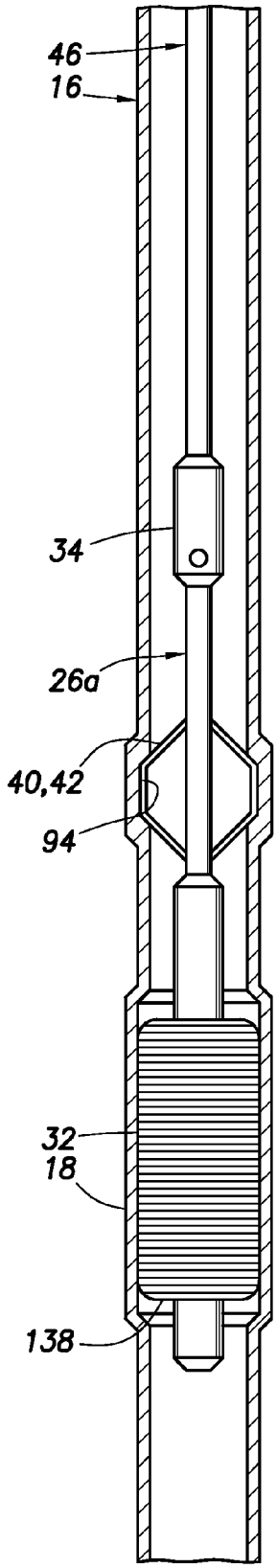
Figure 9C:
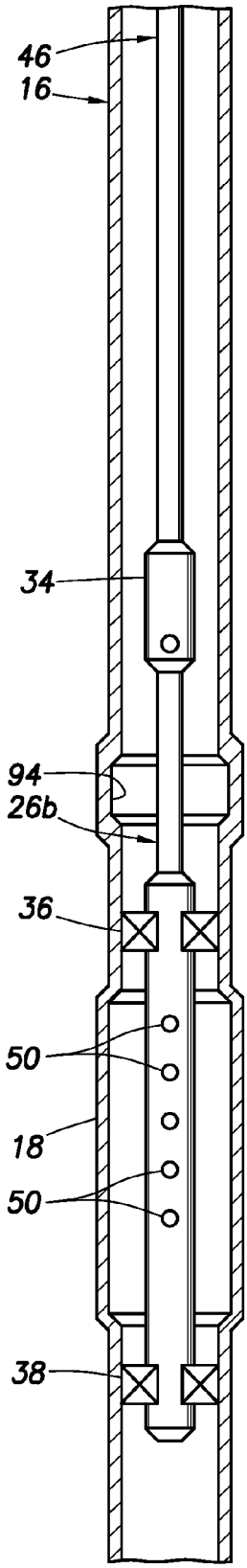

Referring additionally now to FIGS. 9A-C, another alternate configuration of the tool string 26 is representatively illustrated. Specifically, the alternate configuration of FIGS. 9A-C includes an alternate configuration of the casing expander 32.

The casing expander 32 depicted in FIGS. 9A&B includes an inflatable bladder or membrane 138. In FIG. 9A, the membrane 138 is deflated or radially retracted, and in FIG. 9B the membrane is expanded to thereby radially outwardly expand the casing section 18. The subsequent tool string 26*b* of FIG. 9C is similar to the subsequent tool string of FIG. 6C.

Since the casing expander 32 of FIGS. 9A&B does not include the radially oriented pads 52, 54, 56, 58 and pistons 62, 64, 66, 68 for mechanically expanding the casing section 18, the casing expander does not utilize any rotational orientation relative to the casing section. Thus, although the initial tool string 26*a* is depicted in FIGS. 9A&B as including the orienting device 40, its use is not necessary in this configuration.

Figure 39:
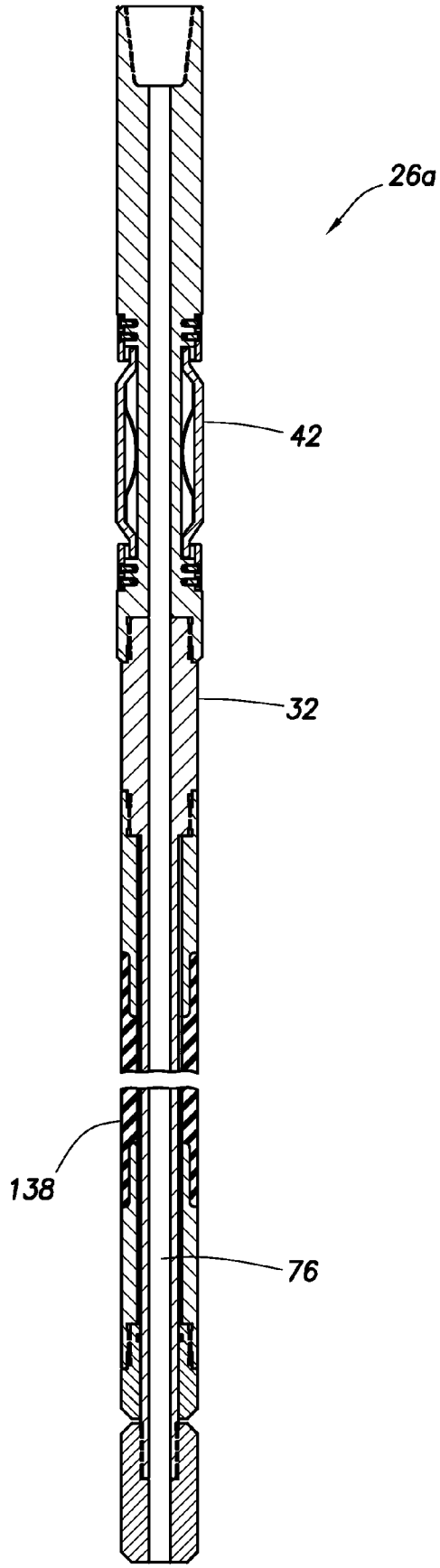
FIG. 39 is a schematic cross-sectional view of an alternate configuration of the tool string of FIGS. 9A-C.

A somewhat enlarged scale cross-sectional view of the casing expander 32 is representatively illustrated in FIG. 39. In this view, the membrane 138 is depicted in its deflated configuration. Preferably, the membrane 138 is of the type used in inflatable packers, but other types of inflatable membranes and other methods of expanding the casing section 18 may be used in keeping with the principles of the invention.

Figure 45:
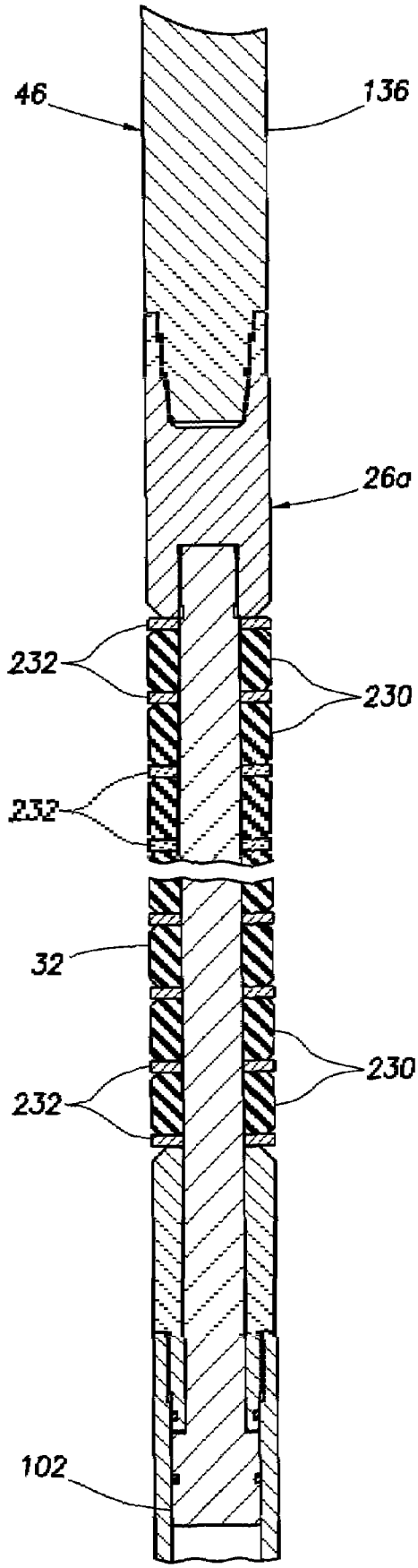
FIG. 45 is a schematic cross-sectional view of an alternate configuration of the tool string of FIGS. 9A-C.

An alternate type of casing expander 32 is representatively illustrated in FIG. 45. The casing expander 32 of FIG. 45 includes longitudinally stacked multiple annular compression elements 230 separated by multiple relatively rigid rings 232.

The compression elements 230 may be made of a relatively flexible and compressible material, such as an elastomer. The rigid rings 232 may be made of a material such as steel. However, the elements 230 and rings 232 may be made of any material in keeping with the principles of the invention.

When a longitudinal compressive force is applied to the elements 230, they extend radially outward and engage the interior of the casing section 18 to thereby expand the casing section radially outward. The rigid rings 232 prevent the elements 230 from overriding each other, and provide for controlled extension of the elements.

The longitudinal compressive force may be applied using any technique, such as application of pressure, manipulation of the tubular string 46, etc. In the example depicted in FIG. 45, the weight collar 136 is used (as well as the weight of the remainder of the tubular string 46 above the tool string 26*a*) to apply set down weight to the casing expander 32. The piston 102 may be used to apply fluid pressure to an anchoring device, such as the pistons 134 and slips 132 depicted in FIG. 7E, during the expansion operation. After the casing section 18 has been expanded, the tubular string 46 may be raised to remove the longitudinal compressive force from the elements 230, and thereby allow the elements to retract for retrieval of the tool string 26*a* from the well.

Figure 10A:
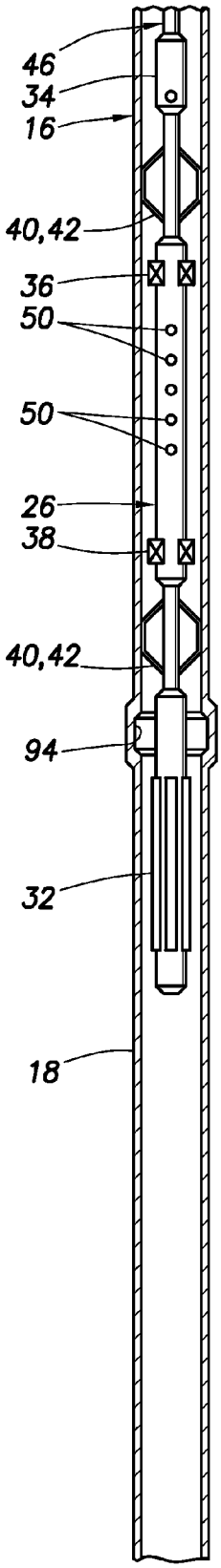
FIGS. 10A-C are schematic partially cross-sectional views of a third alternate configuration of the tool string and associated method, showing a sequence of steps in the method.
Figure 10B:
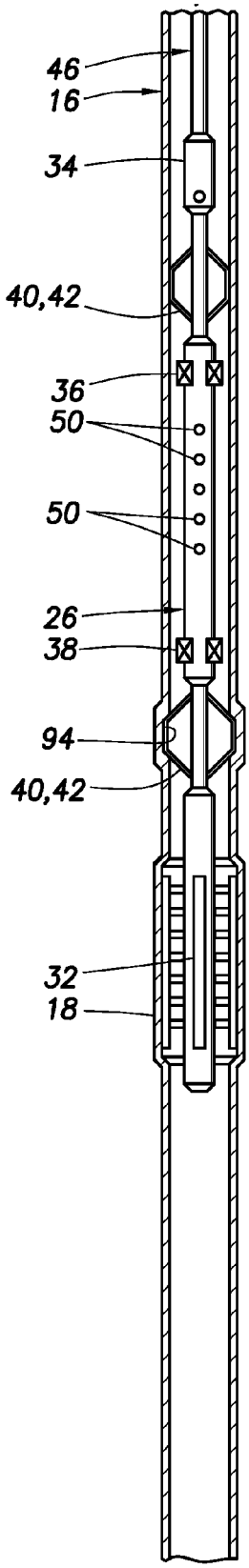
Figure 10C:
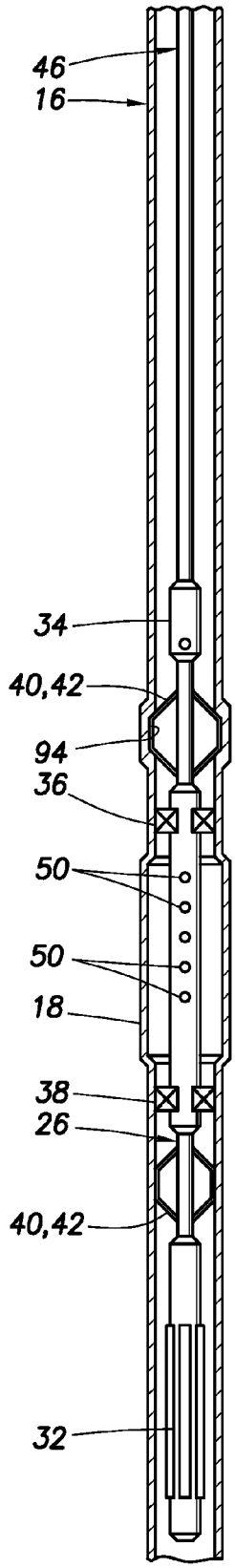

Referring additionally now to FIGS. 10A-C, another alternate configuration of the tool string 26 and associated method are representatively illustrated. In this configuration, only a single trip of the tool string 26 into the well is used to expand the casing section 18 and then to deliver pressurized fluid to propagate the increased permeability planes 22, 24, 90, 92 and stimulate the formation 14.

The configuration of FIGS. 10A-C, thus, differs from the configurations of FIGS. 6A-C & 9A-C at least in that only a single trip of the tool string 26 is used. The configuration of FIGS. 10A-C also differs from the configuration of FIGS. 2-5 at least in that the tool string 26 is repositioned in the casing string 16 between the operations of expanding the casing section 18 and propagating the planes 22, 24, 90, 92.

In FIG. 10A, the tool string 26 is being conveyed into the casing string 16. In FIG. 10B, a lower set of the orienting and anchoring/locating devices 40, 42 has engaged the profile 94 and the casing expander 32 has been operated to radially outwardly expand the casing section 18.

In FIG. 10C, the casing expander 32 has been retracted and the tool string 26 has been lowered in the casing string 16 to engage another set of the orienting and locating devices 40, 42 with the profile 94. The packers 36, 38 are sealingly engaged with the casing string 16 straddling the expanded casing section 18, and pressurized fluid may now be delivered via the ports 50, 70, 72, 74 to propagate the increased permeability planes 22, 24, 90, 92 and/or stimulate the formation 14.

Figure 11A:
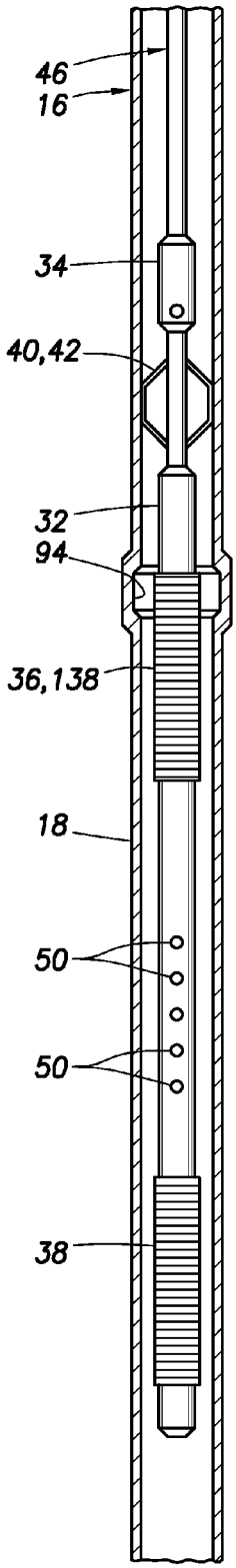
FIGS. 11A-C are schematic partially cross-sectional views of a fourth alternate configuration of the tool string and associated method, showing a sequence of steps in the method.
Figure 11B:
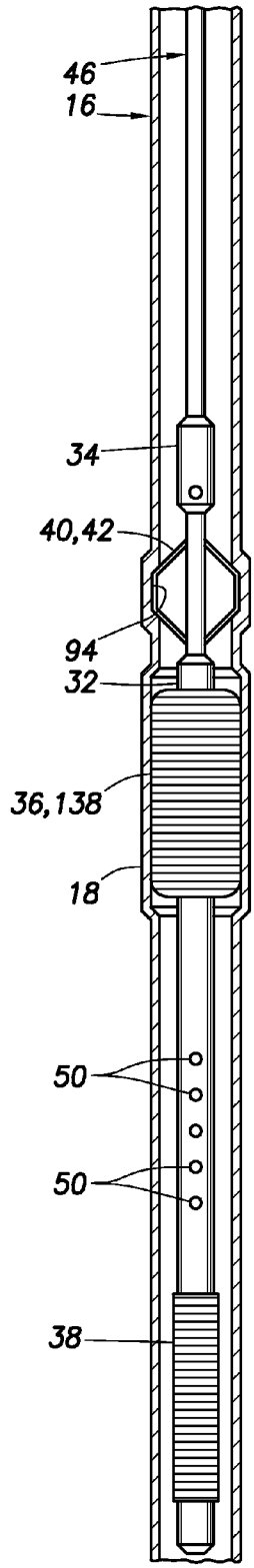
Figure 11C:
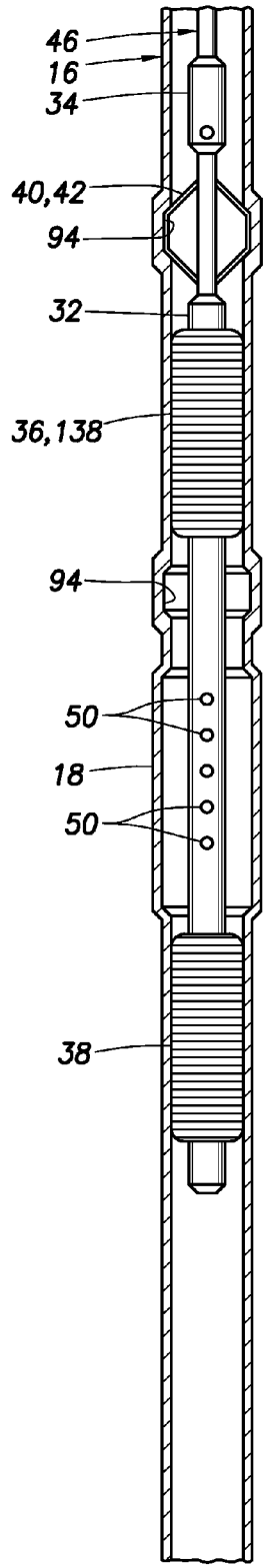

Referring additionally now to FIGS. 11A-C, another alternate configuration of the tool string 26 is representatively illustrated. The configuration of FIGS. 11A-C is very similar to the configuration of FIGS. 10A-C, in that only a single trip of the tool string 26 is used to expand the casing section 18 and propagate the planes 22, 24, 90, 92, and the tool string is repositioned between these operations. However, the casing expander 32 of FIGS. 11A-C utilizes the inflatable membrane 138 and also serves as the upper packer 36.

In FIG. 11A, the tool string 26 is being run into the casing string 16. In FIG. 11B, the orienting and anchoring/locating devices 40, 42 have engaged the profile 94 to align the tool string 26 with the casing section 18. Since the inflatable membrane 138 is used in the casing expander 32, the orienting device 40 may not also be used in the tool string 26.

In FIG. 11B, the membrane 138 has been inflated to thereby radially outwardly expand the casing section 18. After expanding the casing section 18, the membrane 138 is deflated and the tool string 26 is displaced upward to position the packers 36, 38 in the casing string 16 straddling the casing section 18.

In FIG. 11C, the packers 36, 38 are set straddling the casing section 18 and pressurized fluid is delivered via the ports 50, 70, 72, 74 to propagate the increased permeability planes 22, 24, 90, 92 and otherwise stimulate the formation 14. Note that both of the packers 36, 38 may be inflatable packers, and an additional profile 94 may be used in the casing string 16 for engagement by the orienting and anchoring/locating devices 40, 42 to align the ports 50, 70, 72, 74 with the expanded casing section 18.

Figure 12:
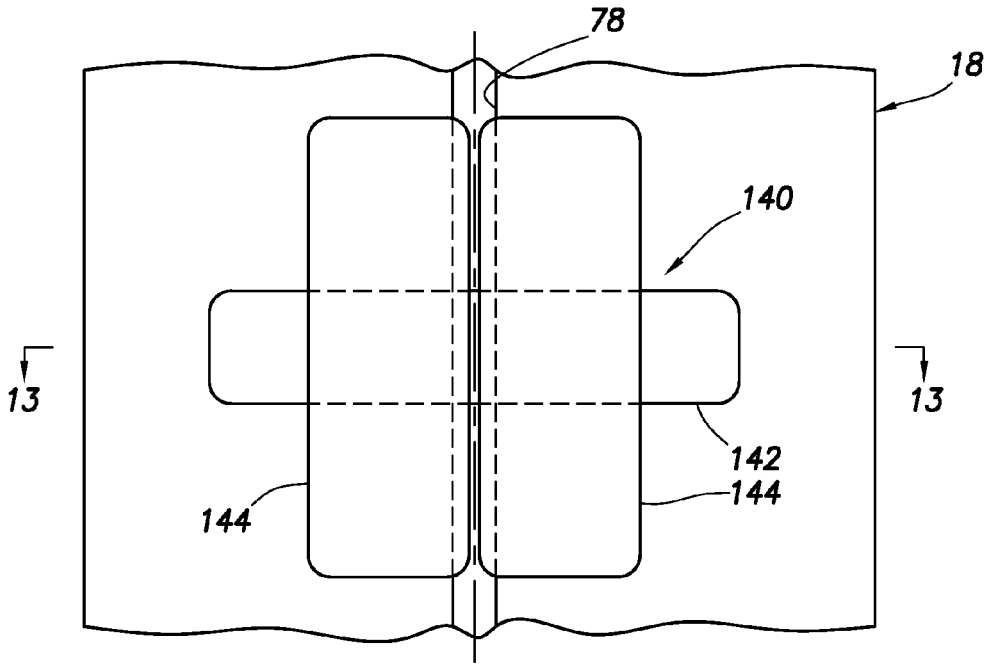
FIG. 12 is an enlarged scale schematic elevational view of a casing section which may be used in the well system and method of FIG. 1.

Referring additionally now to FIG. 12, an elevational view of an alternate configuration of the casing section 18 is representatively illustrated apart from the remainder of the well system 10. In this configuration, the casing section 18 includes features which function to control expansion and contraction of the casing section, so that the stresses 88*a-d*, 128*a-d* are more accurately applied to the formation 14 and the planes 22, 24 90, 92 are more accurately propagated in their respective desired azimuthal directions.

Figure 13:
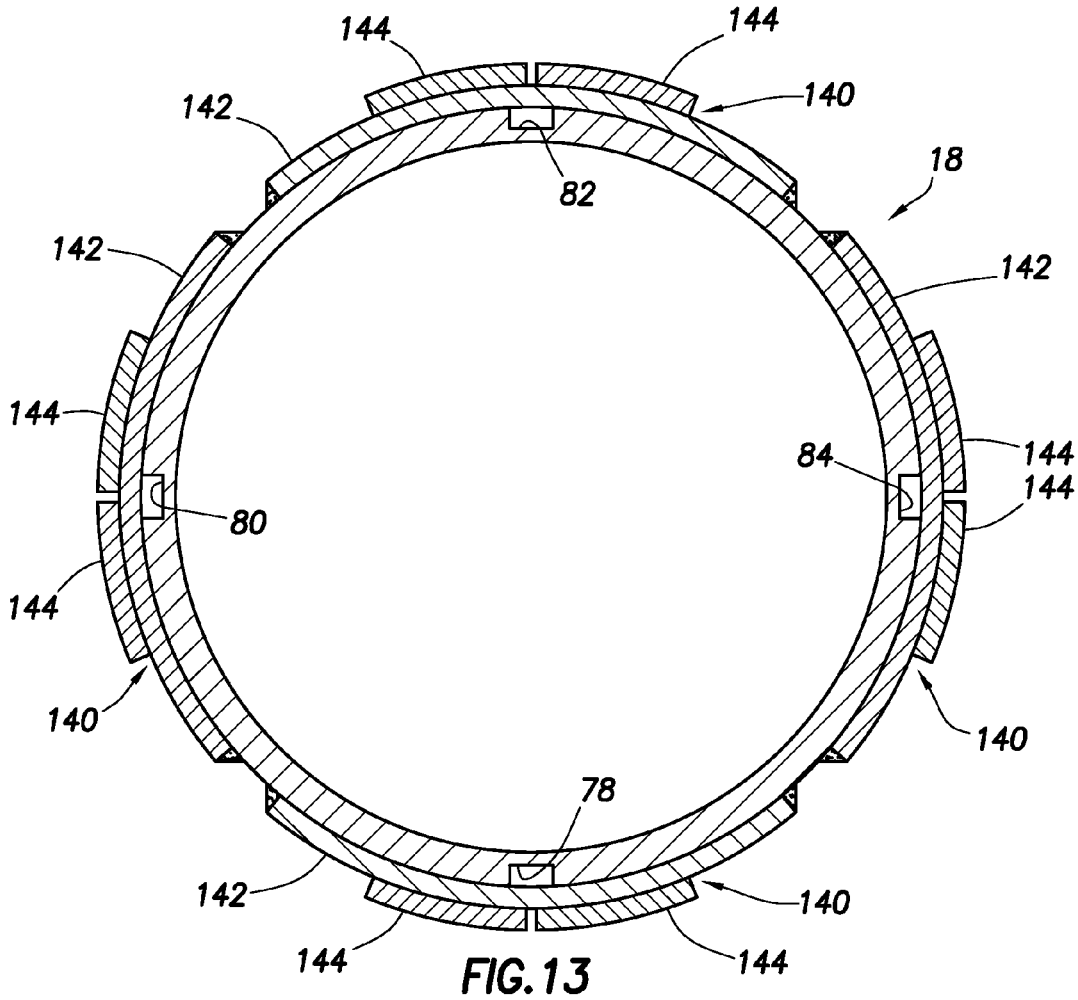
FIG. 13 is a schematic cross-sectional view of the casing section, taken along line 13-13 of FIG. 12.

A cross-sectional view of the casing section 18 configuration of FIG. 12 is representatively illustrated in FIG. 13. In this view it may be seen that the weakened portions 78, 80, 82, 84 of the casing section 18 comprise longitudinally extending slots formed externally on the casing section. It should be understood, however, that other forms of weakened portions may be used in the casing section 18 in keeping with the principles of the invention.

The casing section 18 configuration of FIGS. 12&13 includes an expansion control device 140 positioned adjacent each of the weakened portions 78, 80, 82, 84. Each expansion control device 140 includes a strip 142 of yieldable material attached to the casing section 18 on either lateral side of a respective weakened portion 78, 80, 82, 84, and a retainer 144 attached on each lateral side of the weakened portions.

The yieldable strips 142 may be attached straddling the weakened portions 78, 80, 82, 84 using various methods, such as welding, bonding, fastening, etc. The yieldable strips 142 may be made of any suitable material, such as mild steel, or a highly ductile material, such as nitinol.

In this manner, the strips 142 can yield or elongate when the casing section 18 is expanded and the openings 20, 86 are formed through the weakened portions 78, 80, 82, 84. However, when the force used to expand the casing section 18 is removed, the strips 142 will prevent reclosing of the openings 20, 86, thereby maintaining the stresses 88*a-d*, 128*a-d* in the formation 14 and maintaining the openings 20, 86 open for subsequent delivery of pressurized fluid through the openings to propagate the increased permeability planes 22, 24, 90, 92.

The retainers 144 prevent buckling of the strips 142 when the force used to expand the casing section 18 is removed. The strips 142 are, thus, retained between the retainers 144 and the casing section 18, so that the strips can withstand the compressive load applied to the strips when the force used to expand the casing section is removed.

Although only one of the expansion control devices 140 is depicted in FIGS. 12&13 for each of the weakened portions 78, 80, 82, 84, it will be appreciated that multiple such devices are preferably distributed longitudinally along each of the weakened portions.

The strips 142 prevent reclosing of the openings 20, 86, as well as control the extent to which the openings are widened. By selecting the material of the strips 142 appropriately, selecting the number of devices 140 used, configuring the strips appropriately, etc., a desired expansion of the casing section 18, widening of the openings 20, 86, application of the stresses 88*a-d*, 128*a-d*, and other desirable results may be obtained in response to application of a particular expansion force to the casing section. Conversely, with a known material, configuration and number of the devices 140 used on a particular casing section 18, an appropriate expansion force may be applied to produce a desired widening of the openings 20, 86, application of the stresses 88*a-d*, 128*a-d*, and other desirable results.

Figure 14:
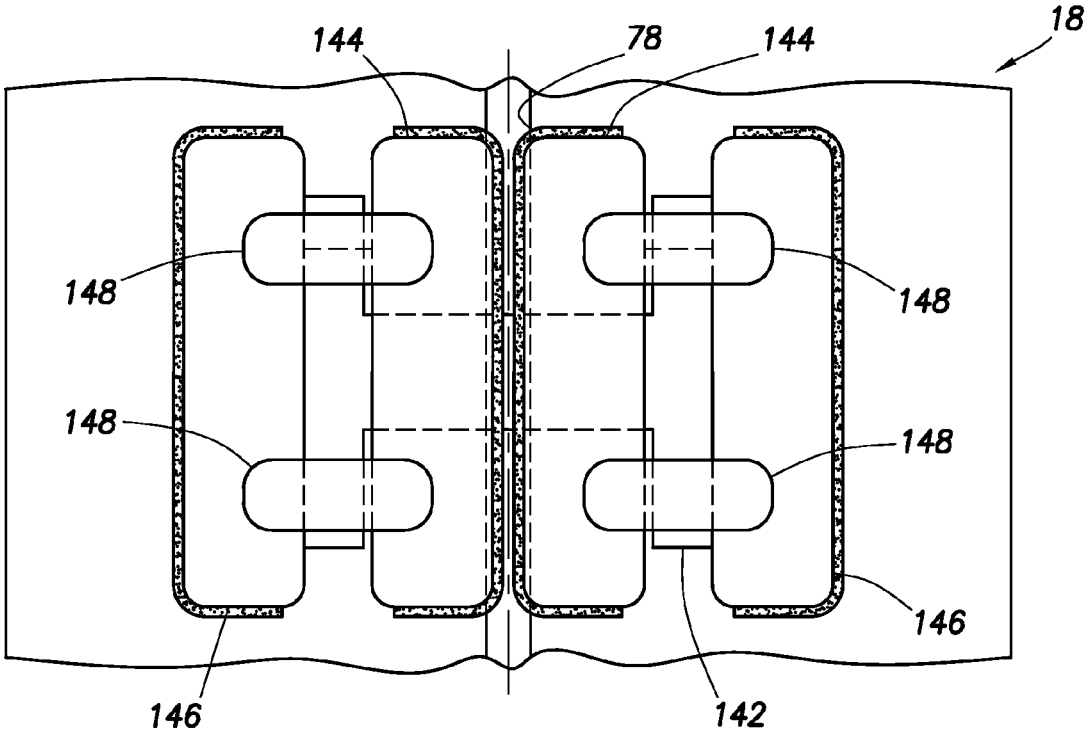
FIG. 14 is a schematic elevational view of a first alternate configuration of the casing section.

Referring additionally now to FIG. 14, an alternate configuration of the casing section 18 is representatively illustrated. In this configuration, the yieldable strip 142 is made of a material (such as nitinol, etc.) which is not conveniently weldable to the material of which the casing section 18 is made, or it is otherwise undesirable to weld the strip to the casing section.

To solve this problem, the strip 142 is retained by the retainers 144 as in the configuration of FIGS. 12&13, but additional retainers 146, 148 are also used, so that ends of the strip are "captured" adjacent the casing section 18. In this manner, both compression and tension can be applied to the strip 142 due to expansion of the casing section 18 and removal of the expansion force, without directly attaching the strip to the casing section by welding.

Figure 15:
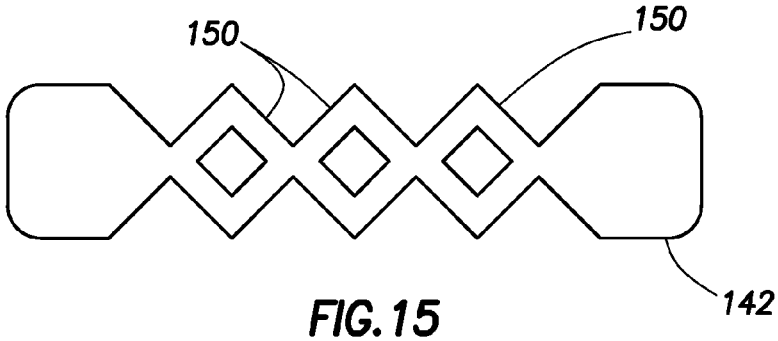
FIGS. 15-17 are enlarged scale schematic elevational views of alternate configurations of expansion control devices.
Figure 16:
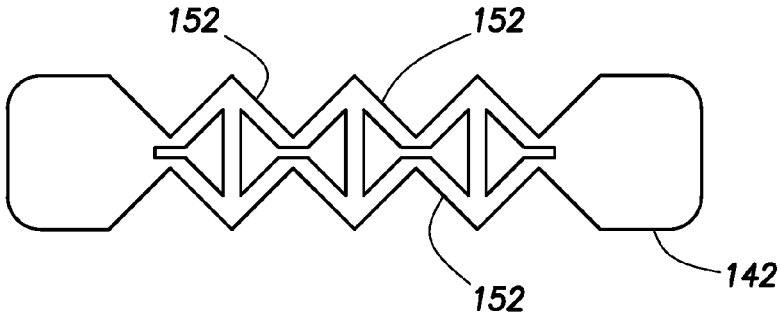
Figure 17:
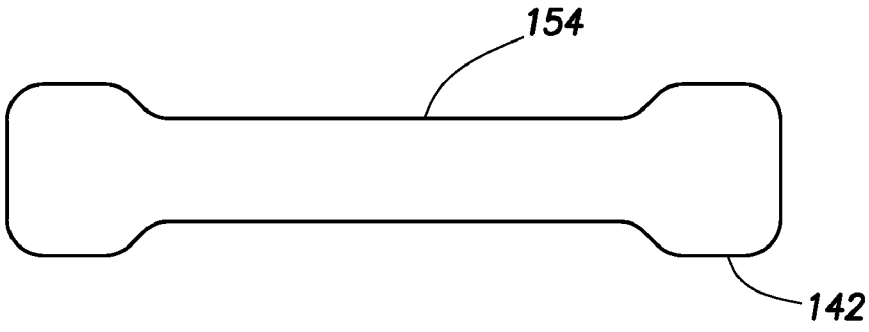

Referring additionally now to FIGS. 15-17, alternate configurations of the yieldable strip 142 are representatively illustrated. These configurations demonstrate additional ways in which the strip 142 may be used to control expansion of the casing section 18.

The configuration of FIG. 15 includes hollow diamond-shaped portions 150 formed between ends of the strip 142. The diamond-shaped portions 150 will relatively easily collapse when the strip 142 is elongated during expansion of the casing section 18, but the strip will still be able to resist reclosing of the openings 20, 86 when the expansion force is removed. Thus, the strip 142 desirably reduces the expansion force needed to produce a certain expansion of the casing section 18.

The configuration of FIG. 16 is similar in some respects to the configuration of FIG. 15, at least in that it reduces the expansion force needed to expand the casing section 18. However, instead of collapsing the diamond-shaped portions 150, lattice-shaped portions 152 of the FIG. 16 configuration are expanded and strengthened when the strip 142 is elongated, thereby increasing the buckling strength of the strip when it is elongated. Thus, the strip 142 of FIG. 16 both reduces the expansion force needed to produce a certain expansion of the casing section 18 and has an increased capability for resisting reclosing of the openings 20, 86.

The configuration of FIG. 17 is very similar to the strip 142 of FIG. 12, except that it has a reduced width central portion 154. This configuration demonstrates one manner in which the shape of the strip 142 may be altered to adjust the manner in which the device 140 controls expansion of the casing section 18. The material of the strip 142 could also be changed to alter the expansion of the casing section 18, for example, by making the strip of a highly work hardening material, so that the material tensile strength increases as it is elongated, etc.

Figure 18:
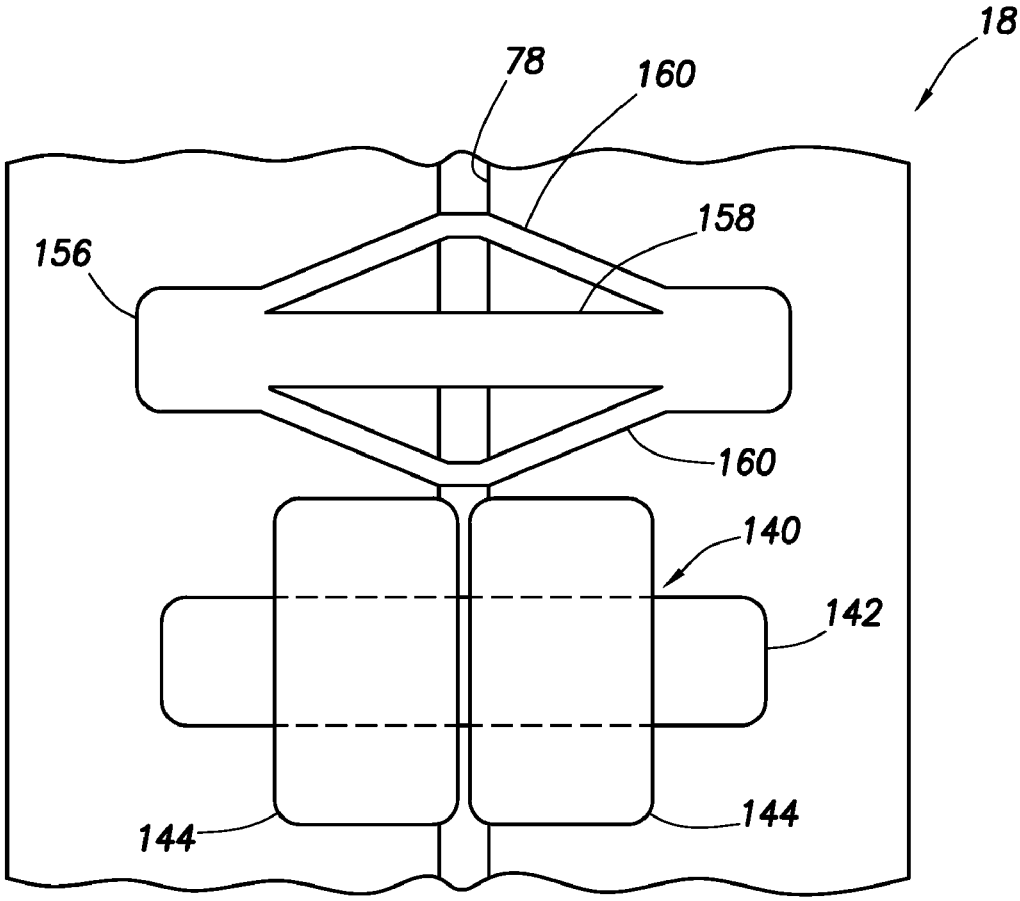
FIG. 18 is a schematic elevational view of a second alternate configuration of the casing section.

Referring additionally now to FIG. 18, another alternate configuration of the casing section 18 is representatively illustrated. In this configuration, the expansion control device 140 includes an expansion limiter 156. The expansion limiter 156 is attached to the casing section 18 on either lateral side of the weakened portions 78, 80, 82, 84 in order to limit the widening of the openings 20, 86, limit the application of stresses 88*a-d*, 128*a-d* to the formation 14, etc.

The expansion limiter 156 includes a straight central portion 158 which elongates in a certain known manner in response to application of expansion force to the casing section 18, as well as curved or folded portions 160 which initially elongate relatively easily in response to the expansion force. However, when the portions 160 have been straightened, the expansion force needed to further elongate the expansion limiter 156 is substantially increased.

In this manner, expansion of the casing section 18 can be more accurately controlled, even though the expansion force is not as readily or accurately controllable. Thus, a broader range of expansion force is permitted to produce a certain desired amount of expansion of the casing section 18.

As depicted in FIG. 18, the expansion limiter 156 may be used in conjunction with the strip 142 and retainers 144. Alternatively, the expansion limiter 156 could be used in place of the strip 142.

Figure 41:
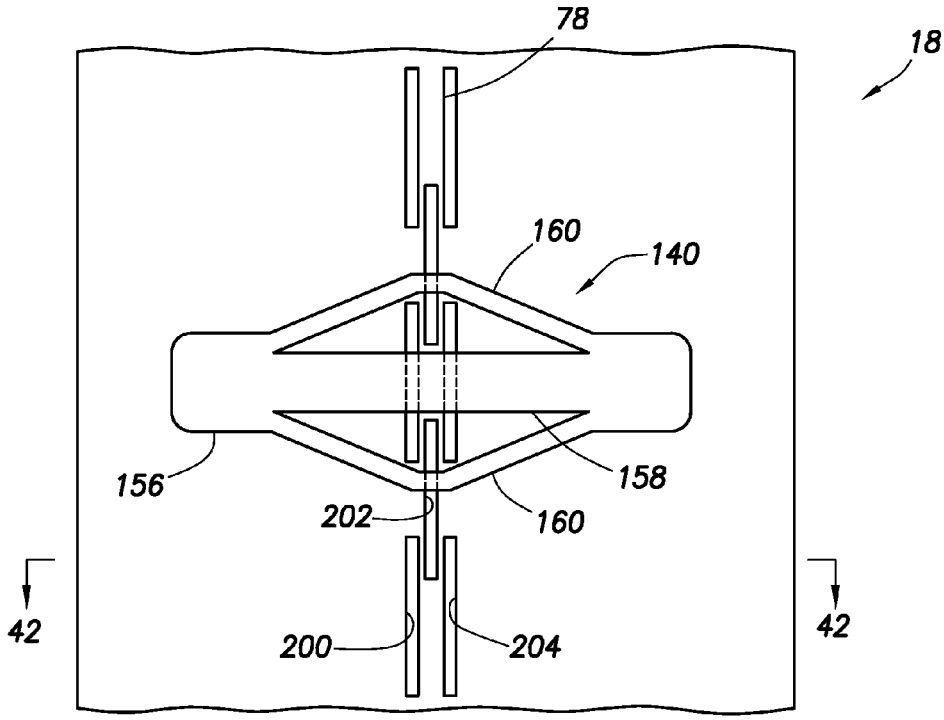
FIG. 41 is an enlarged scale schematic cross-sectional view of a twelfth alternate configuration of the casing section.
Figure 42:
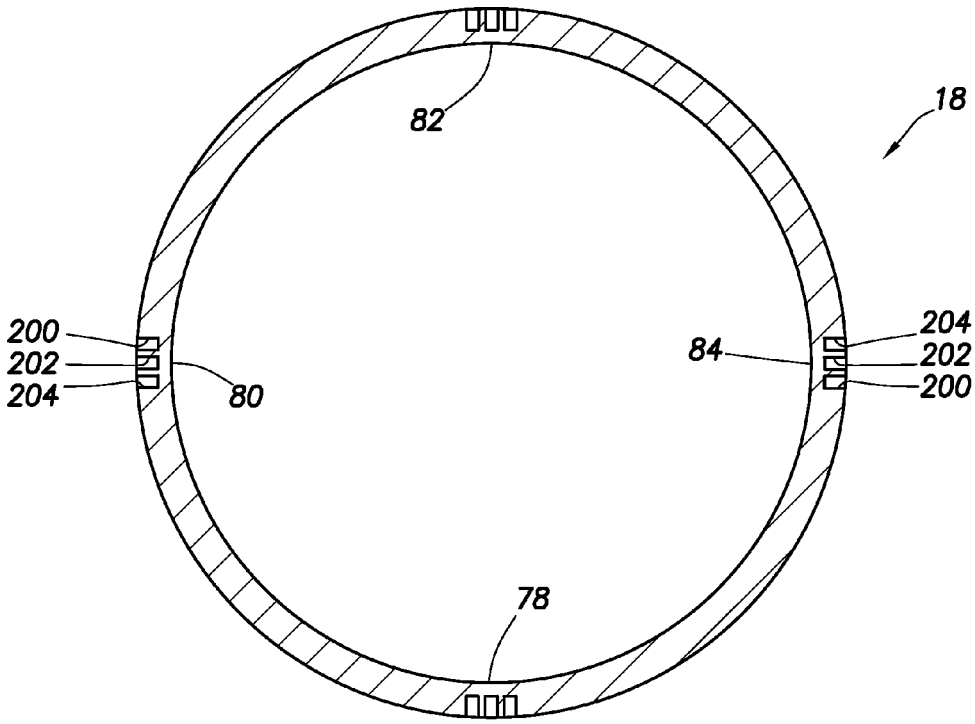
FIG. 42 is a schematic elevational view of the casing section of FIG. 41, viewed from line 42-42 of FIG. 41.

Referring additionally now to FIGS. 41&42, another alternate configuration of the casing section 18 is representatively illustrated. In this configuration, the expansion limiter 156 is used as the expansion control device 140 apart from the strip 142 and retainers 144.

In addition, the weakened portions 78, 80, 82, 84 in the configuration of FIGS. 41&42 each include multiple slots 200, 202, 204 formed externally on the casing section 18. A series of multiple ones of each of the slots 202, 202, 204 is longitudinally distributed along the casing section 18, with the slots 202 alternating longitudinally with pairs of the slots 200, 204. There is some overlap between the slots 202 and the pairs of slots 200, 204, with the slots 202 being positioned between the slots 200, 204 at the overlaps.

Figure 19:
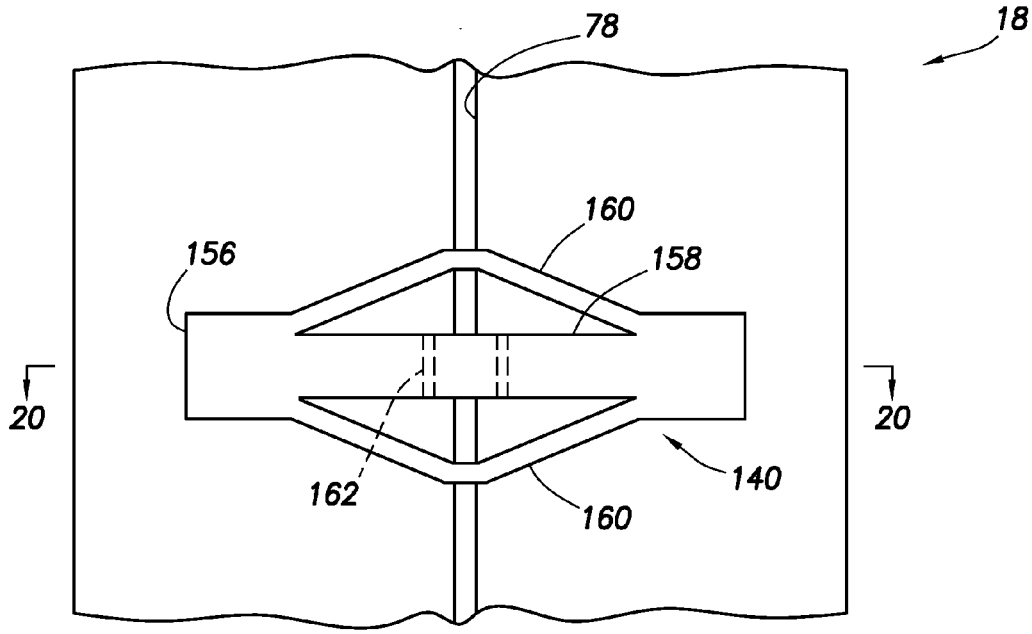
FIG. 19 is a schematic elevational view of a third alternate configuration of the casing section.
Figure 20:
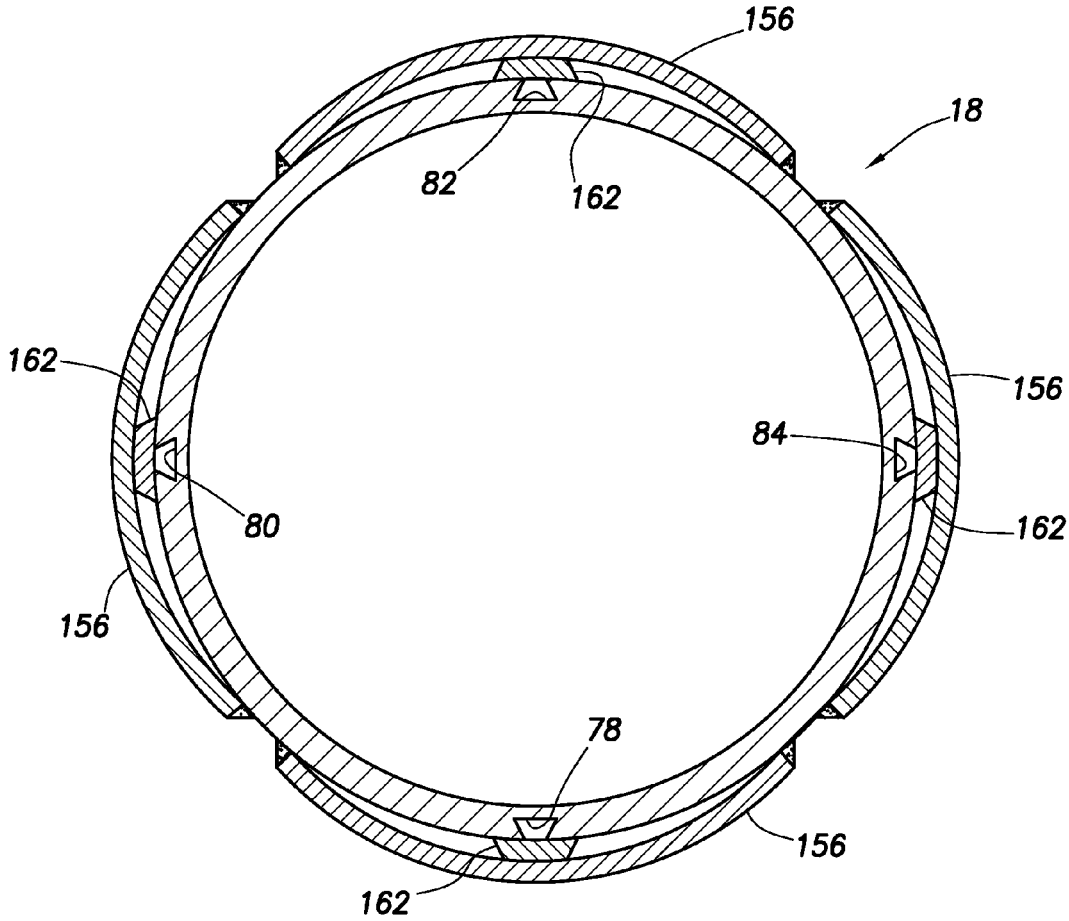
FIG. 20 is a schematic cross-sectional view of the casing section of FIG. 19, taken along line 20-20 of FIG. 19.

Referring additionally now to FIGS. 19&20, another alternate configuration of the casing section 18 is representatively illustrated. In this configuration, the expansion control device 140 includes an alternate configuration of the expansion limiter 156 in which the central portion 158 has a wedge or prop 162 formed on its inner surface.

The prop 162 is used to prevent reclosing of the openings 20, 86 when the expansion force used to expand the casing section 18 is removed. Note that, as depicted in FIG. 20, the props 162 are complementarily shaped relative to the weakened portions 78, 80, 82, 84, so that the props will engage lateral edges of the openings 20, 86 and prop the openings open at a desired width when the expansion force is removed. Preferably, the props 162 and weakened portions 78, 80, 82, 84 have a dovetail or trapezoidal shape as illustrated in FIG. 20, but other shapes may be used if desired.

Figure 22:
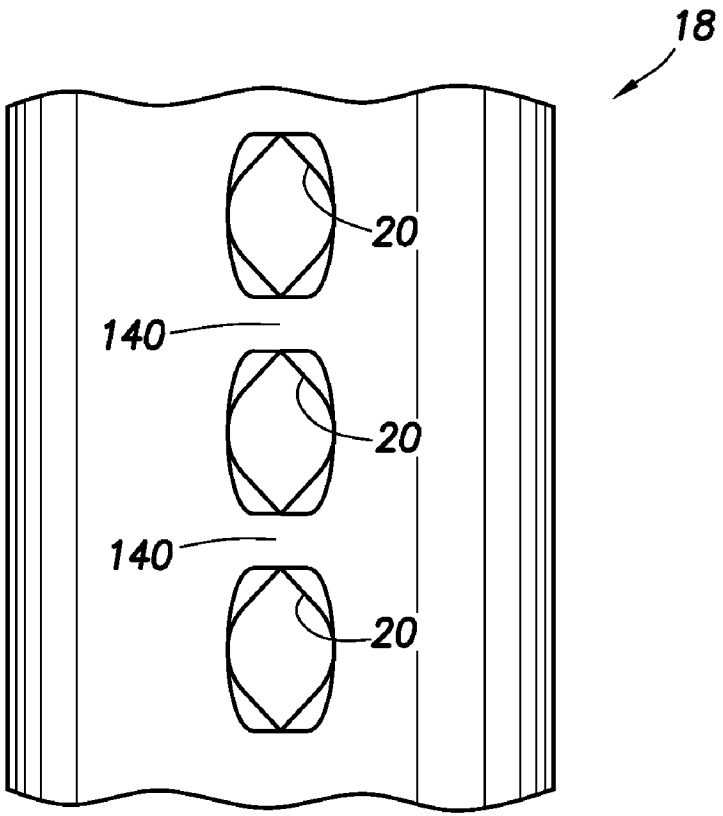
FIG. 22 is a schematic elevational view of a fifth alternate configuration of the casing section.
Figure 21:
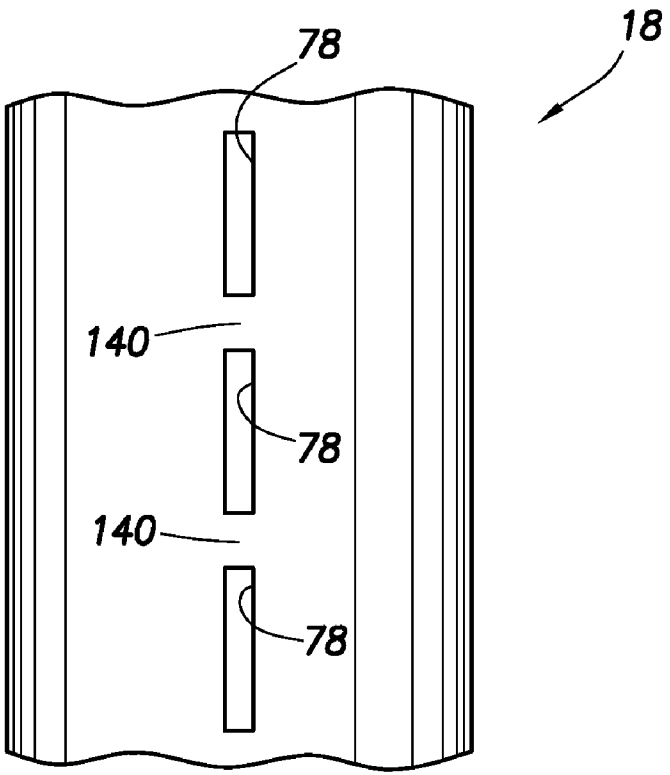
FIG. 21 is a reduced scale schematic elevational view of a fourth alternate configuration of the casing section.

Referring additionally now to FIGS. 21&22, another alternate configuration of the casing section 18 is representatively illustrated. The casing section 18 is depicted in FIG. 21 prior to expansion, and in FIG. 22 after expansion.

The casing section 18 has a series of longitudinally extending and longitudinally spaced apart external slots formed thereon as the weakened portions 78, 80, 82, 84. Longitudinally between the slots are the expansion control devices 140 in the form of full cross-section thickness portions of the casing section sidewall.

Of course, it is not necessary for the devices 140 to be formed as full cross-section thicknesses of the casing section sidewall. Alternatively, the thicknesses of the devices 140 may be adjusted to thereby control the expansion of the casing section 18 in response to a certain expansion force.

In FIG. 22 it may be seen that the devices 140 have been elongated due to the expansion force used to expand the casing section 18, but the devices are still capable of preventing reclosing of the openings 20 when the expansion force is removed. In this regard, the devices 140 are similar to the strips 142 included in the devices of FIGS. 12-18, but the devices of FIGS. 21&22 are preferably integrally formed as a part of the casing section 18, instead of being separately formed and then attached to the casing section.

Figure 23:
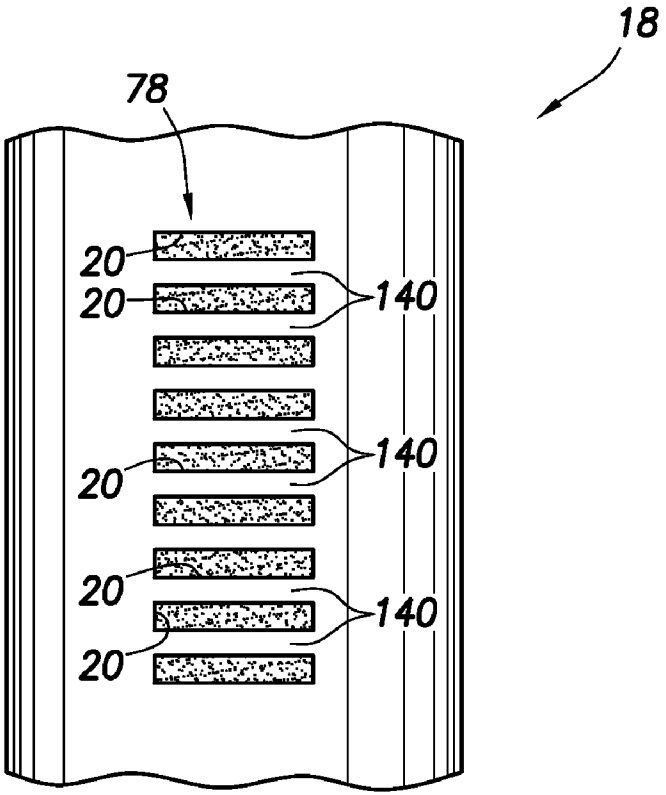
FIG. 23 is a schematic elevational view of a sixth alternate configuration of the casing section.

Referring additionally now to FIG. 23, another alternate configuration of the casing section 18 is representatively illustrated. In this configuration, the expansion control devices 140 are similar to those of FIGS. 21&22, but the devices of FIG. 23 are circumferentially elongated and a greater number of the devices are used. This configuration demonstrates that the shape and number of the devices 140 may be used to control the expansion of the casing section 18 in response to a certain expansion force.

Note that, instead of slots between the devices 140, the weakened portions 78, 80, 82, 84 could include the openings 20, 86 themselves. The openings 20, 86 could be widened circumferentially in response to expansion of the casing section 18. To prevent flow through the openings 20, 86 during cementing operations, a substance could be used to temporarily plug the openings, an internal retrievable sleeve could be used to block the openings, etc.

Figure 24:
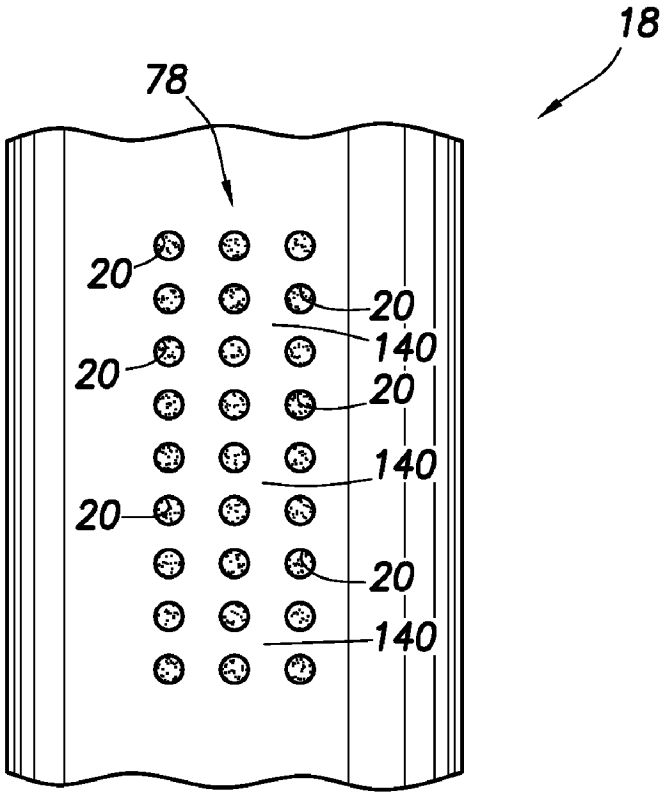
FIG. 24 is a schematic elevational view of a seventh alternate configuration of the casing section.

Referring additionally now to FIG. 24, another alternate configuration of the casing section 18 is representatively illustrated. In this configuration, a pattern of longitudinally distributed openings 20, 86 form the weakened portions 78, 80, 82, 84. The expansion control devices 140 are formed longitudinally between the openings 20, 86.

The openings 20, 86 may be initially fully formed through the sidewall of the casing section 18, in which case the openings may be temporarily plugged or closed off until completion of cementing operations. Alternatively, the openings 20, 86 may be initially only partially formed through the sidewall of the casing section 18, in which case the openings may be fully formed through the casing sidewall in response to expansion of the casing section.

Referring additionally now to FIGS. 25&26, another alternate configuration of the casing section 18 is representatively illustrated. This configuration is somewhat similar to the configuration of FIGS. 12&13, except that longitudinal rod reinforcements 164 are attached to the casing section 18 straddling each of the weakened portions 78, 80, 82, 84 and cable reinforcements 166 extend between the rod reinforcements.

The reinforcements 164, 166 are used to reinforce the hardened fluid 28, so that the hardened fluid does not break apart undesirably when the casing section 18 is expanded. That is, the reinforcements 164, 166 permit the hardened fluid 28 to withstand the increased compressive stresses 88*a-d* applied thereto when the casing section 18 is expanded, and to transmit these stresses to the surrounding formation 14. Note that the rod reinforcements 164 straddle the weakened portions 78, 80, 82, 84 so that, when the openings 20, 86 are formed, the hardened fluid 28 is prevented from caving into the openings.

Figure 27:
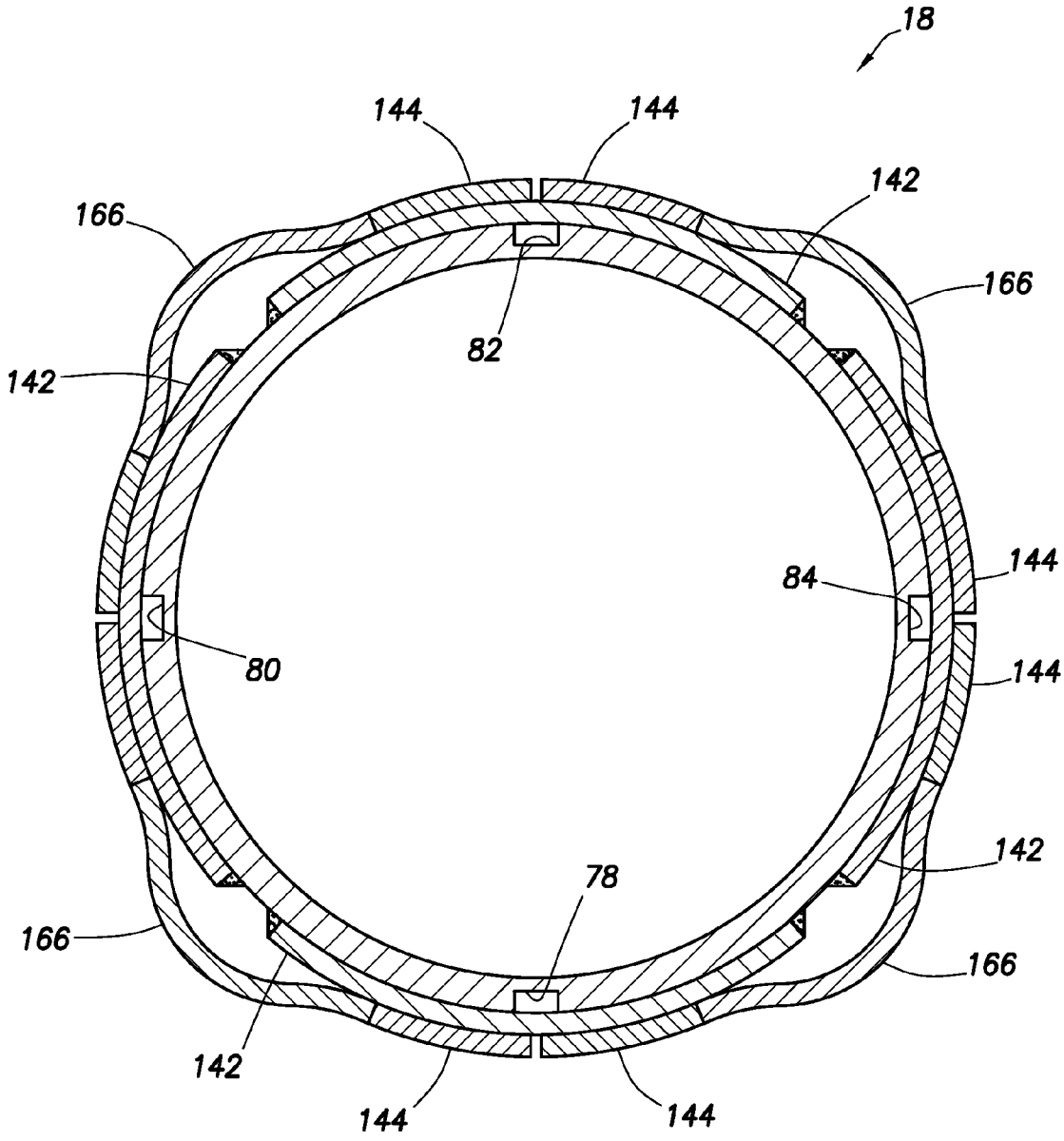
FIG. 27 is a schematic cross-sectional view of a ninth alternate configuration of the casing section.

Referring additionally now to FIG. 27, another alternate configuration of the casing section 18 is representatively illustrated. This configuration is similar in some respects to the configuration of FIGS. 25&26. However, the rod reinforcements 164 are not used in the FIG. 27 configuration, and the cable reinforcements 166 are attached between the retainers 144 instead of between the rod reinforcements. The rod reinforcements 164 could be used in the configuration of FIG. 27, if desired.

Figure 28:
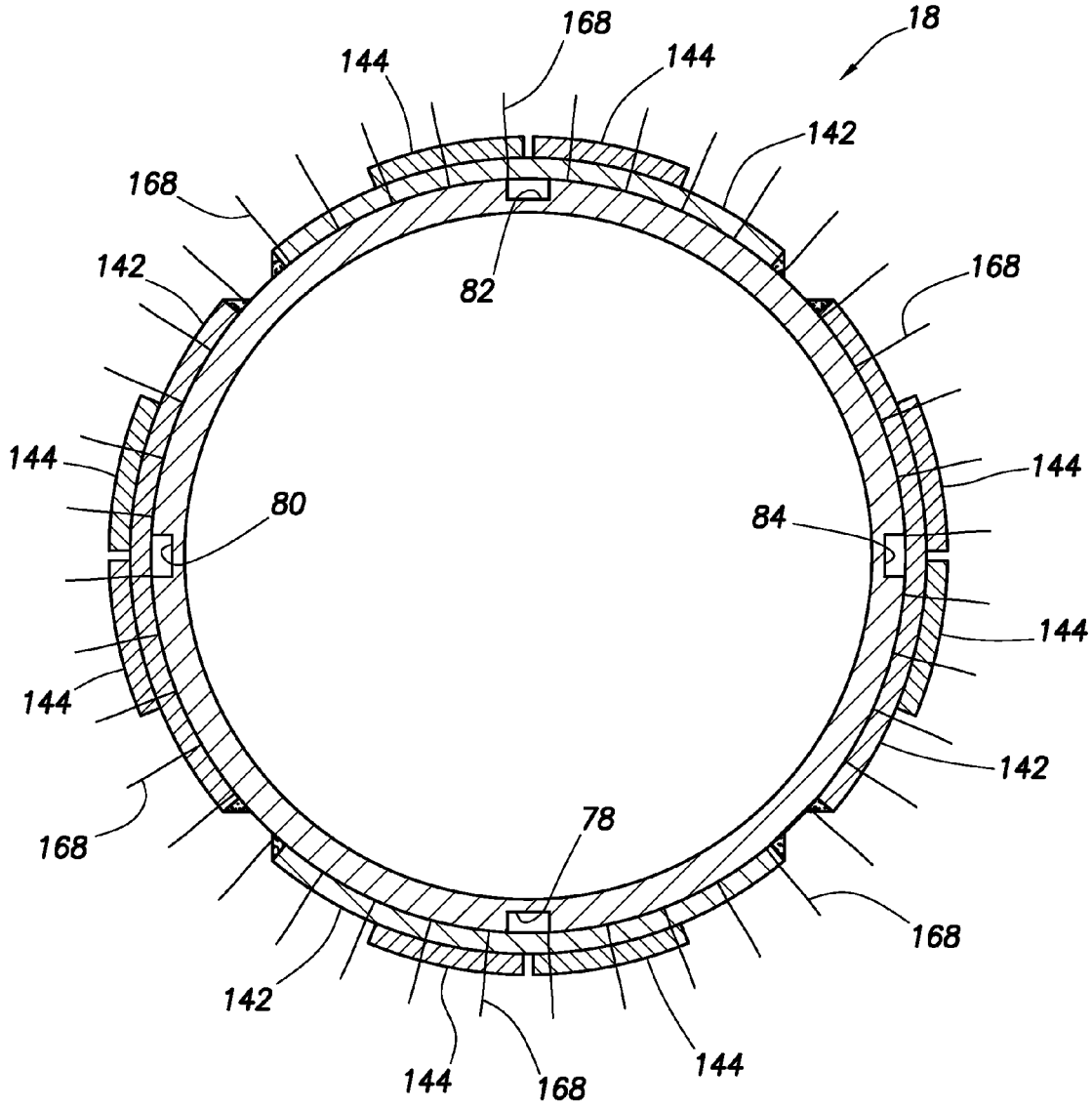
FIG. 28 is a schematic cross-sectional view of a tenth alternate configuration of the casing section.

Referring additionally now to FIG. 28, another alternate configuration of the casing section 18 is representatively illustrated. In this configuration, reinforcements in the form of thin, elongated members 168 are used extending radially outwardly from the casing section. The members 168 could, for example, be in the form of wires, fibers, strips, ribbons or other elongated members which have substantial strength and which may be readily attached to the exterior of the casing section 18.

Figure 29:
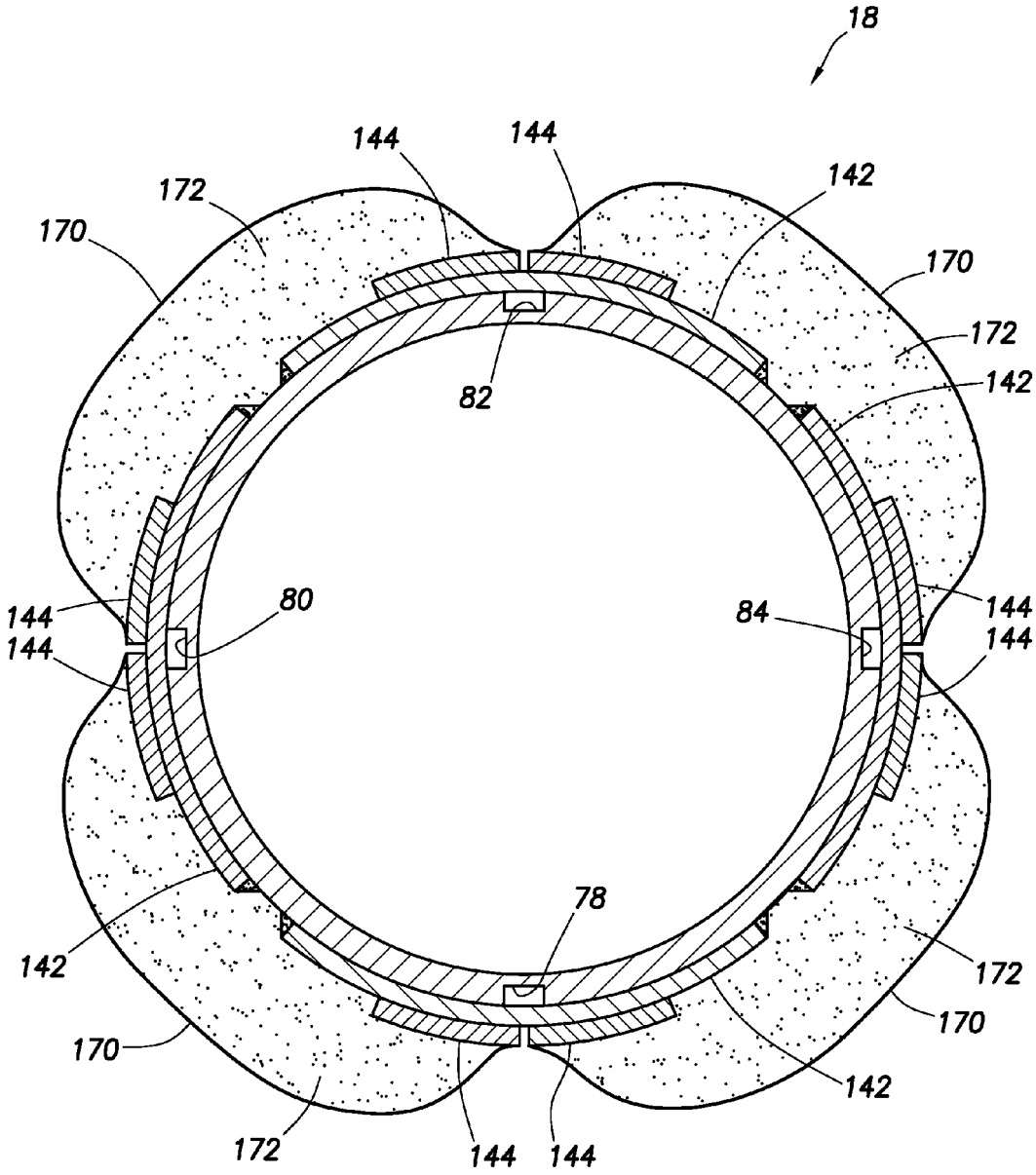
FIG. 29 is a schematic cross-sectional view of an eleventh alternate configuration of the casing section.

Referring additionally now to FIG. 29, another alternate configuration of the casing section 18 is representatively illustrated. In this configuration, it is desired to reduce the volume of the hardened fluid 28 in the annulus 30 surrounding the casing section 18.

For example, if the hardened fluid 28 is conventional cement, it may be presumed that in a particular situation the cement would not be able to acceptably withstand the increased compressive stresses 88*a-d* applied to the cement when the casing section is expanded. To reduce the volume of the hardened fluid 28 in the annulus 30 surrounding the casing section 18, bags or membranes 170 may be provided on the casing section between the weakened portions 78, 80, 82, 84.

The membranes 170 are preferably filled with a hardenable fluid 172 which is more capable of withstanding the compressive stresses 88*a-d* than the fluid 28. The hardenable fluid 172 would preferably be injected into the membranes 170 prior to cementing the casing string 16 in the wellbore 12.

The hardenable fluid 172 could include any suitable type of, or combination of, polymers, cements, etc., and could have solids, fiber reinforcement, swellable materials, etc., therein.

Figure 30:
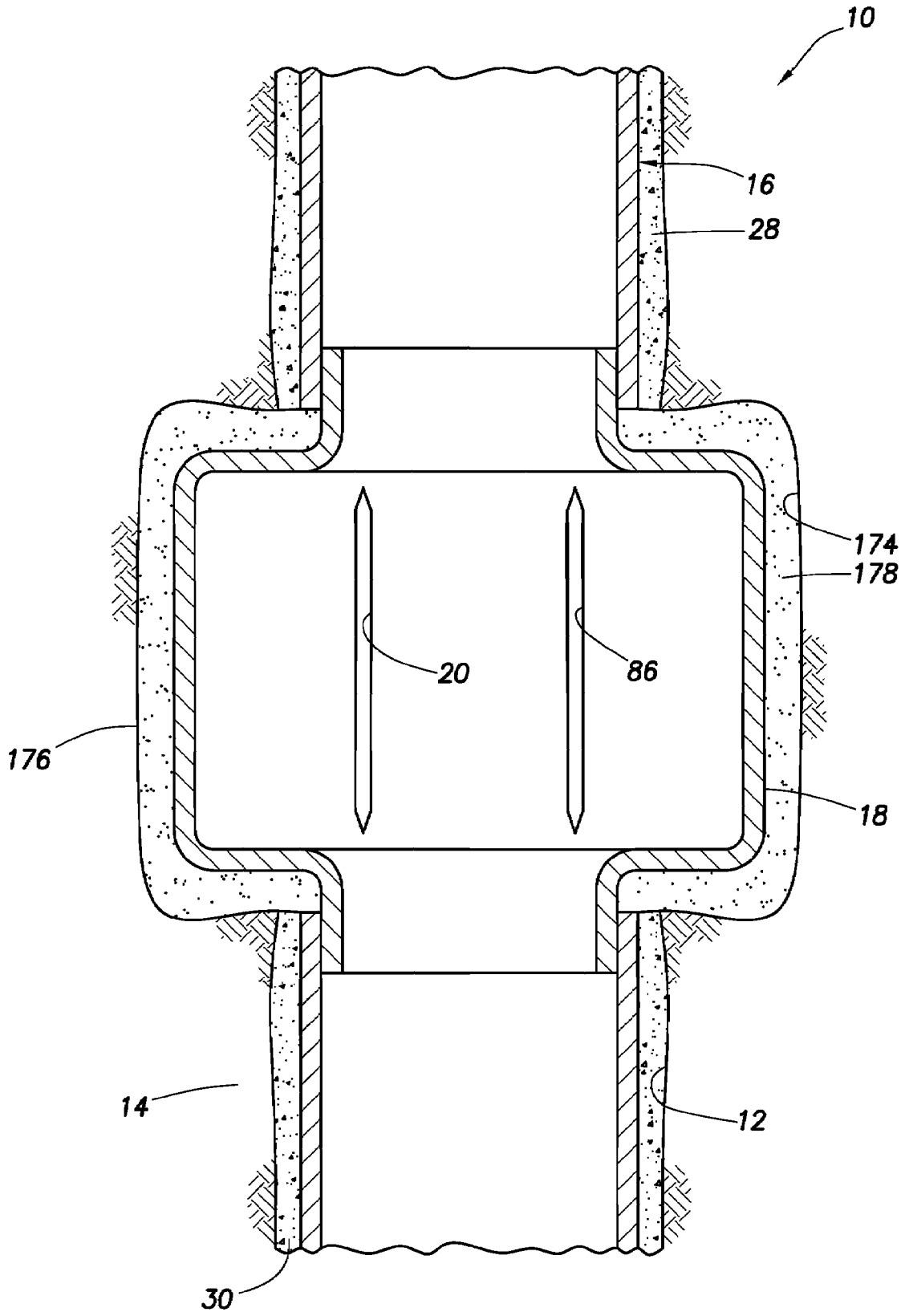
FIG. 30 is a reduced scale schematic cross-sectional view of a first alternate configuration of the well system and associated method.

Referring additionally now to FIG. 30, an alternate configuration of the well system 10 and associated method are representatively illustrated. In this configuration, the casing string 16 is retrofit with the casing section 18, instead of the casing section being a part of the casing string when it is initially installed in the wellbore 12. This configuration of the well system 10 may be particularly useful when it is desired to stimulate flow of fluid between the wellbore 12 and the formation 14 in an existing well which did not originally have the casing section 18 installed therein.

Prior to installing the casing section 18 in the casing string 16, the casing string is milled through and an underreamed cavity 174 is formed in the wellbore using conventional techniques. The casing section 18 in its unexpanded condition is then conveyed into the casing string 16 and positioned straddling the underreamed cavity 174.

Cement or another hardenable fluid 176 is then flowed into an annulus 178 formed between the casing section 18 and the underreamed cavity 174. The fluid 176 is allowed to harden in the annulus 178.

Once the fluid 176 is sufficiently hardened, the casing section 18 is then expanded radially outward using any of the techniques described above. As a result, the openings 20, 86 are formed through the sidewall of the casing section 18, the increased compressive stresses 88*a-d* and reduced stresses 128*a-d* are applied to the formation 14, etc. as described above.

After expansion of the casing section 18, the planes 22, 24, 90, 92 are propagated as described above. Any of the configurations of the tool string 26 described above may be used for the expansion and propagation operations, and any of the configurations of the casing section 18 described above may be used in the well system 10 of FIG. 30.

Figure 31:
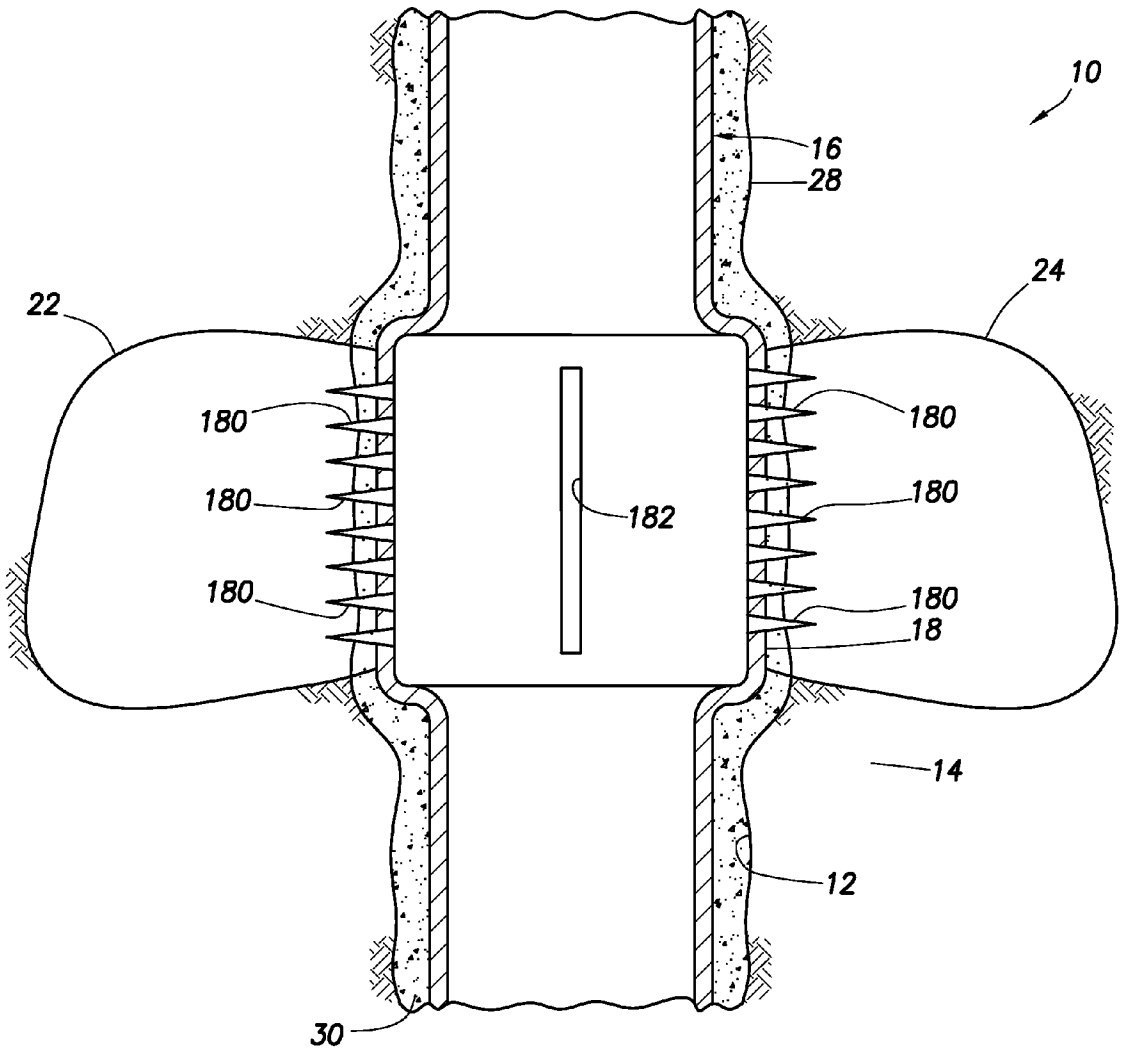
FIG. 31 is a schematic cross-sectional view of a second alternate configuration of the well system and associated method.

Referring additionally now to FIG. 31, another alternate configuration of the well system 10 and associated method are representatively illustrated. In this configuration, the openings 20, 86 are not necessarily formed at the time the casing section 18 is expanded.

Instead, the casing section 18 is first expanded using any of the techniques described above. The increased compressive stresses 88*a-d* and reduced stresses 128*a-d* are thus applied and maintained in the formation 14 surrounding the wellbore 14.

Then, after the expansion operation is completed, penetrations 180 are formed extending outwardly from the casing section 18 and into the formation 14. This relieves the stresses 128*a-d* in the area of the formation 14 pierced by the penetrations, but the increased compressive stresses 88*a-d* remain in the formation. This condition is believed to result in more control over the azimuthal direction of each of the increased permeability planes 22, 24, 90, 92.

As depicted in FIG. 31, the penetrations 180 may be formed by perforating the casing section 18, through the hardened fluid 28 and into the formation 14 using a conventional perforating gun with the perforating charges longitudinally aligned. Alternatively, the penetrations 180 may be in the form of one or more slots 182 cut through the casing section 18, through the hardened fluid 28, and into the formation 14, for example, using jet cutting or milling techniques.

After the penetrations 180 are formed, pressurized fluid is delivered through the penetrations to the formation 14 to propagate the planes 22, 24, 90, 92 substantially as described above. One significant difference in the configuration of FIG. 31 is that the penetrations 180 are formed into the formation 14 after completion of the expanding operation, and then the increased permeability planes 22, 24, 90, 92 are propagated radially outward into the formation. By separating these operations in this manner, each of the operations can be more accurately and individually performed, and without interference from, or the need to design around as many requirements of, the other operations.

Any of the configurations of the tool string 26 described above may be used for the expanding and propagating operations. In addition, any of the tool string 26 configurations described above could be provided with perforating guns, jet cutting equipment, milling equipment, etc., as desired to form the penetrations 180. Alternatively, the penetrations 180 could be formed using one or more separate tool strings.

Figure 43:
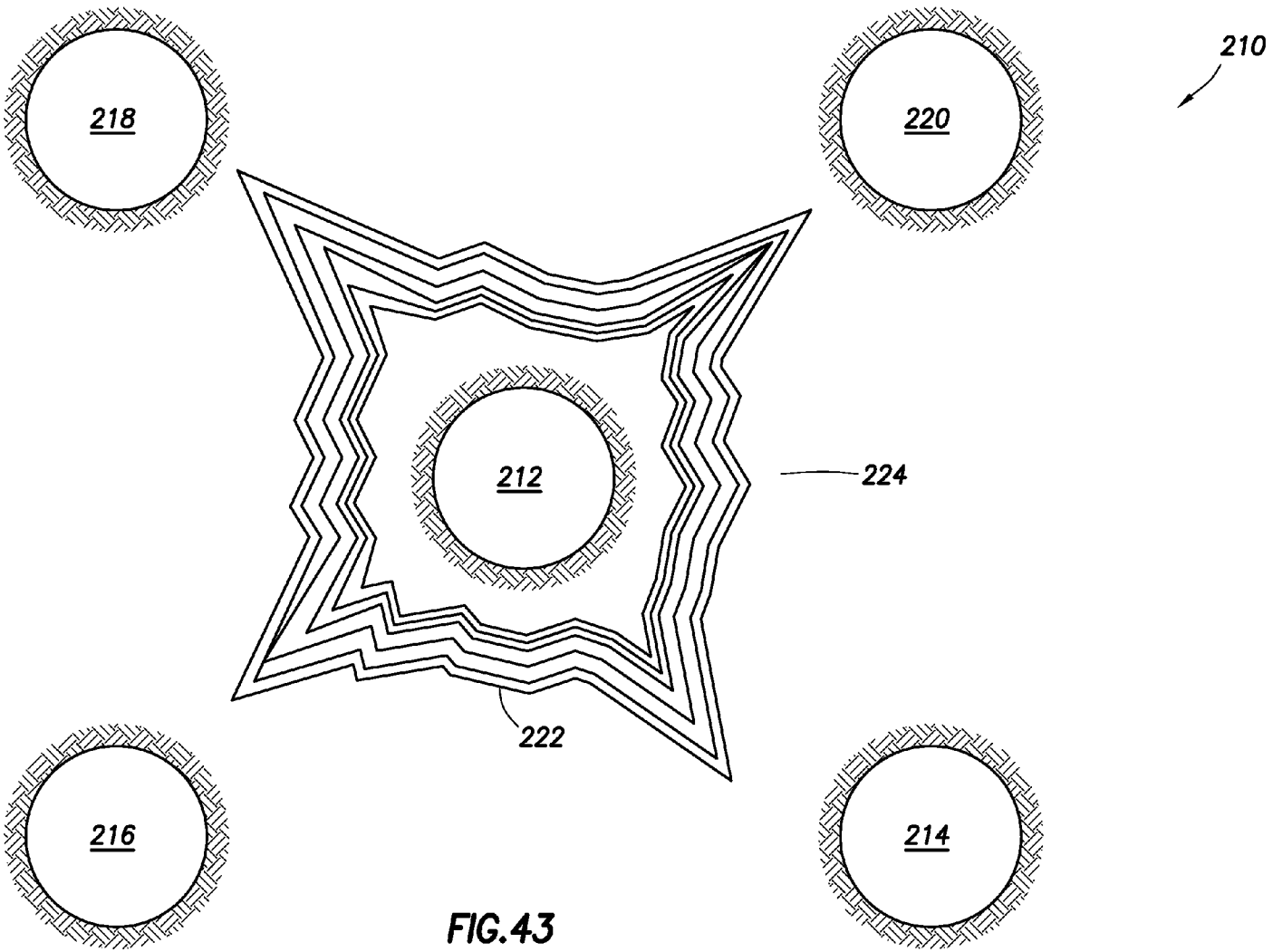
FIG. 43 is a schematic plan view of another well system and associated method which embody principles of the invention.

Referring additionally now to FIG. 43, a schematic plan view of another well system 210 and associated method which may benefit from the principles of the invention is representatively illustrated. In this view it may be seen that a central wellbore 212 is being used to inject water 222 into a subterranean formation 224, in order to drive hydrocarbon fluids toward surrounding wellbores 214, 216, 218, 220. One of the wellbores 220 has begun to experience water breakthrough, and it is desired to impede the flow of the water 222 toward the wellbore.

Figure 44:
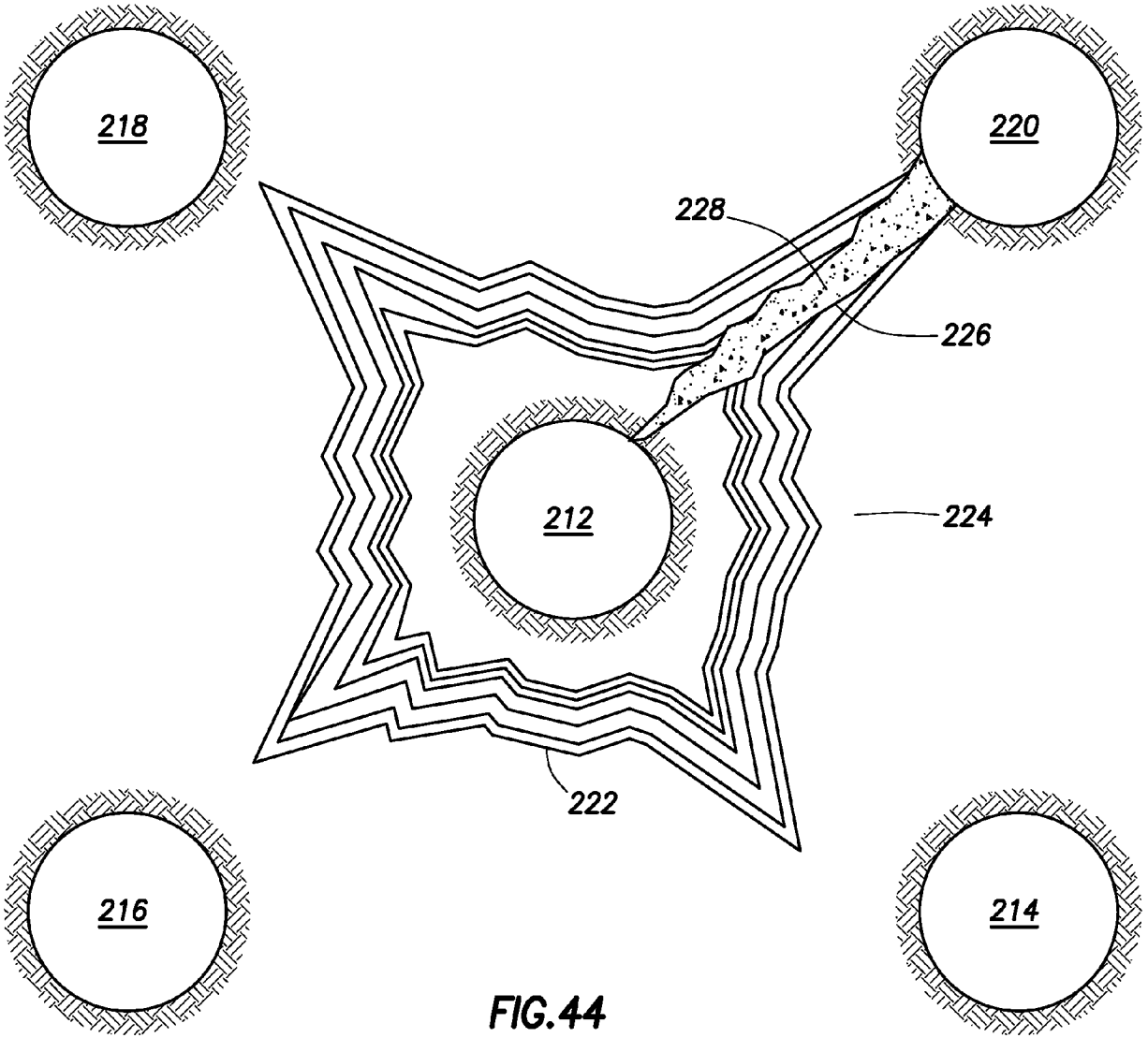
FIG. 44 is a schematic plan view of the well system and method of FIG. 43, in which additional steps in the method have been performed.

In FIG. 44 it may be seen that an increased permeability plane 226 has been propagated into the formation 224 from the wellbore 220. Any of the methods described above may be used for initiating and propagating the plane 226 into the formation 224. It is expected that the plane 226 will be propagated along substantially the same path along which the water 222 flows through the formation 224.

After propagating the plane 226, it is filled with cement or another material 228 capable of sealing off the plane, or at least substantially restricting flow through the plane. The sealing material 228 could flow into the pores of the formation 224 surrounding the plane 226, and the plane and material could extend completely, or only partially, to the water flood wellbore 212. Thus, water flow to the wellbore 220 is substantially restricted using the method of FIGS. 43&44.

Although the various embodiments of the well system 10, tool string 26 and casing section 18 have been separately described above, it should be clearly understood that any element or feature of any of these embodiments could be used in any of the other embodiments. In particular, any combination of the elements and features described above may be constructed, without departing from the principles of the invention.

It may now be fully appreciated that the well system 10, tool string 26 and casing section 18 embodiments described above provide significant improvements in the art of propagating planes in controlled azimuthal directions and associated stimulation of formations. In part, these improvements stem from the controlled application of a desired stress regime in a formation prior to propagating the increased permeability planes through the formation.

Thus has been described a method of forming one or more increased permeability planes 22, 24, 90, 92 in a subterranean formation 14. The method preferably includes the steps of: installing the casing section 18 in the wellbore 12 intersecting the formation 14; expanding the casing section in the wellbore; and then injecting a fluid into the formation, the injecting step being performed after the expanding step is completed.

The method may also include the steps of, prior to the expanding step, positioning the hardenable fluid 28 in the annulus 30 between the casing section 18 and the wellbore 12, and permitting the hardenable fluid to harden.

The expanding step may include applying the reduced stresses 128*a-d* to the formation 14, the reduced stresses being directed orthogonal to the wellbore 12 intersecting the formation 14.

The method may include the step of, after the expanding step is completed, piercing the formation 14 with one or more penetrations 180 extending radially outward from the wellbore 12, thereby relieving the reduced stresses 128*a-d* at the penetrations.

The expanding step may include applying the increased compressive stresses 88*a-d* to the formation 14, the increased compressive stresses being radially directed relative to the wellbore 12 intersecting the formation.

The method may include the step of, after the expanding step is completed, piercing the formation 14 radially outward from the wellbore 12, thereby initiating the planes 22, 24, 90, 92.

The expanding step may include forming one or more openings 20, 86 through the sidewall of the casing section 18.

The expanding step may include increasing a width of one or more openings 20, 86 in the sidewall of the casing section 18, and the method may include the step of preventing a reduction of the opening widths after the expanding step.

The expanding step may include increasing a width of one or more openings 20, 86 in the sidewall of the casing section 18, and the method may include the step of limiting the widths of the openings.

The expanding step may include using a fluid to expand the casing section 18 which is different from the fluid injected into the formation 14 to propagate the planes 22, 24, 90, 92.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A method of forming at least one increased permeability plane in a subterranean formation, the method comprising the steps of:

installing a casing section in a wellbore intersecting the formation;

positioning a hardenable fluid in an annulus between the casing section and the wellbore;

permitting the hardenable fluid to harden;

expanding the casing section, thereby applying radially directed increased compressive stresses to at least two circumferential portions of the wellbore; and then injecting a first fluid into the formation, thereby propagating the at least one increased permeability plane between the at least two circumferential portions of the wellbore, the injecting step being initiated after the expanding step is completed.

2. The method of claim 1, wherein the expanding step further comprises reducing a stress in the formation, the reduced stress being directed orthogonal to a wellbore intersecting the formation.

3. The method of claim 2, further comprising the step of, after the expanding step is completed, piercing the formation with at least one penetration extending radially outward from the wellbore, thereby relieving the reduced stress at the penetration.

4. The method of claim 1, wherein the expanding step further comprises applying a compressive stress to the formation, the compressive stress being radially directed relative to a wellbore intersecting the formation.

5. The method of claim 4, further comprising the step of, after the expanding step is completed, piercing the formation radially outward from the wellbore, thereby initiating the plane.

6. The method of claim 1, wherein the expanding step further comprises forming at least one opening through a sidewall of the casing section.

7. The method of claim 1, wherein the expanding step further comprises increasing a width of at least one opening in a sidewall of the casing section, and further comprising the step of preventing a reduction of the opening width after the expanding step.

8. The method of claim 1, wherein the expanding step further comprises increasing a width of at least one opening in a sidewall of the casing section, and further comprising the step of limiting the width of the opening.

9. The method of claim 1, wherein the expanding step further comprises using a second fluid to expand the casing section, the second fluid being different from the first fluid.

10. A method of forming at least one increased permeability plane in a subterranean formation, the method comprising the steps of:

applying an increased compressive stress to the formation, the compressive stress being radially directed to at least two circumferential portions of a wellbore intersecting the formation; and then propagating the plane between the at least two circumferential portions by injecting a first fluid into the formation radially outward from the wellbore, wherein the increased compressive stress applying step is completed prior to performing the propagating step.

11. The method of claim 10, wherein the compressive stress applying step is performed by expanding a casing section radially outward in the wellbore.

12. The method of claim 11, wherein the expanding step is completed prior to performing the propagating step.

13. The method of claim 11, wherein the expanding step further comprises forming at least one opening through a sidewall of the casing section.

14. The method of claim 11, wherein the expanding step further comprises increasing a width of at least one opening in a sidewall of the casing section, and further comprising the step of preventing a reduction of the opening width after the expanding step.

15. The method of claim 11, wherein the expanding step further comprises increasing a width of at least one opening in a sidewall of the casing section, and further comprising the step of limiting the width of the opening.

16. The method of claim 11, further comprising the step of enlarging the plane by injecting the first fluid through at least one opening in a sidewall of the casing section.

17. The method of claim 16, wherein the enlarging step is performed after the expanding step is completed.

18. The method of claim 16, wherein the expanding step further comprises using a second fluid to expand the casing section, the second fluid being different from the first fluid.

19. The method of claim 10, wherein the propagating step further comprises forming penetrations into the formation after the expanding step.

20. The method of claim 19, wherein the penetrations forming step further comprises forming a longitudinally extending slot in the wellbore.

21. The method of claim 19, wherein the penetrations forming step further comprises forming perforations into the formation.

22. A method of forming at least one increased permeability plane in a subterranean formation, the method comprising the steps of:

installing a casing section in a wellbore intersecting the formation;

positioning a hardenable fluid in an annulus between the casing section and the wellbore;

permitting the hardenable fluid to harden;

reducing a stress in the formation by expanding the hardened fluid radially outward in the wellbore, the reduced stress being directed orthogonal to the wellbore; and then piercing the formation with at least one penetration extending radially outward from the wellbore, thereby relieving the reduced stress at the penetration, and the hardened fluid expanding step being completed prior to the piercing step being initiated.

23. The method of claim 22, wherein the piercing step further comprises perforating the formation.

24. The method of claim 22, wherein the piercing step further comprises forming a longitudinally extending slot in the wellbore.

25. The method of claim 24, wherein the slot extends through the casing section lining the wellbore.

26. The method of claim 22, wherein the stress reducing step is performed by expanding the casing section radially outward in the wellbore.

27. The method of claim 26, wherein the expanding step is completed prior to performing the piercing step.

28. The method of claim 26, wherein the expanding step further comprises forming at least one opening through a sidewall of the casing section.

29. The method of claim 26, wherein the expanding step further comprises increasing a width of at least one opening in a sidewall of the casing section, and further comprising the step of preventing a reduction of the opening width after the expanding step.

30. The method of claim 26, wherein the expanding step further comprises increasing a width of at least one opening in a sidewall of the casing section, and further comprising the step of limiting the width of the opening.

31. The method of claim 26, further comprising the step of enlarging the plane by injecting a first fluid through at least one opening in a sidewall of the casing section.

32. The method of claim 31, wherein the enlarging step is performed after the expanding step is completed.

33. The method of claim 31, wherein the expanding step further comprises using a second fluid to expand the casing section, the second fluid being different from the first fluid.

* * * * *